US008276327B1

(12) United States Patent
Pellegrene et al.

(10) Patent No.: US 8,276,327 B1
(45) **Date of Patent: *Oct. 2, 2012**

(54) RELOCATABLE CONCRETE ARMORY VAULT

(75) Inventors: James Pellegrene, North Canton, OH (US); Jeffery Augustine, Wake Forest, NC (US); Gregg Zuckett, Chagrin Falls, OH (US)

(73) Assignee: Diebold, Incorporated, North Canton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/134,909

(22) Filed: Jun. 20, 2011

Related U.S. Application Data

(63) Continuation of application No. 11/601,610, filed on Nov. 17, 2006, now Pat. No. 7,963,073.

(60) Provisional application No. 60/737,991, filed on Nov. 18, 2005.

(51) Int. Cl.
*E04G 23/06* (2006.01)

(52) U.S. Cl. ..... 52/125.2; 52/79.11; 52/124.2; 52/125.4; 52/142; 109/83

(58) Field of Classification Search ..... 52/36.1, 52/36.2, 79.5, 79.1, 79.6, 79.14, 79.11, 125.3, 52/125.4, 128, 142, 139, 124.1; 109/83, 109/1 S, 11
See application file for complete search history.

(56) References Cited

U.S. PATENT DOCUMENTS 5,048,257 A * 9/1991 Luedtke ..... 52/747.1
7,594,361 B2 * 9/2009 Tragant Ruano ..... 52/79.9
* cited by examiner

*Primary Examiner* — Phi Dieu Tran A
(74) *Attorney, Agent, or Firm* — Ralph E. Jocke; Daniel D. Wasil; Walker & Jocke

(57) ABSTRACT

A relocatable concrete armory includes an outer vestibule and an inner vault separated by a dividing wall. A vestibule door provides entry to the concrete vestibule. A steel vault door and a security daygate are mounted to the dividing wall and provide entry to the concrete vault. The interior surface of the armory includes insulation panels embedded in concrete. The armory can be integrally lifted via removable lifting cams attached to concrete side walls. The concrete has a compressive strength of at least 15,000 psi.

20 Claims, 19 Drawing Sheets

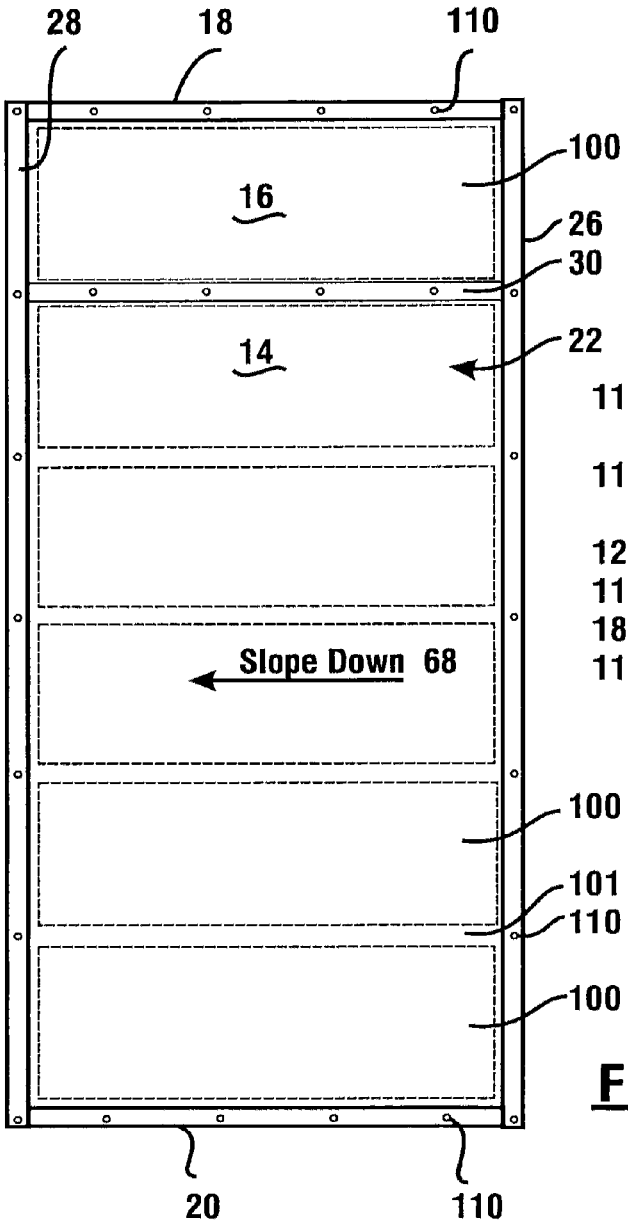
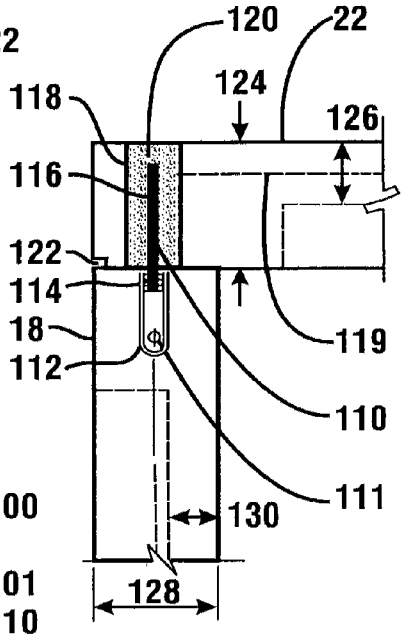
FIG. 17
FIG. 11B 202
208
200
190
210

208
200

206
204

190
192
194

200
212
190

212
214
218

190
190
220
222
214

190

216
214
190

RELOCATABLE CONCRETE ARMORY VAULT

CROSS REFERENCE TO RELATED APPLICATIONS

This application is a continuation of U.S. application Ser. No. 11/601,610 filed Nov. 17, 2006, now U.S. Pat. No. 7,963,073, which claims the benefit of U.S. provisional application 60/737,991 filed Nov. 18, 2005, which disclosures are herein incorporated by reference.

TECHNICAL FIELD

This invention relates to vaults. Specifically this invention relates to an armory vault apparatus, system, and methods of providing and using the vault apparatus.

BACKGROUND ART

Armory vaults consisting of steel are known.

DISCLOSURE OF INVENTION

It is an object of an exemplary embodiment of the invention to provide an enclosure.

It is a further object of an exemplary embodiment of the invention to provide an enclosure comprising a vault.

It is a further object of an exemplary embodiment of the invention to provide a concrete vault.

It is a further object of an exemplary embodiment of the invention to provide a concrete armory vault.

It is a further object of an exemplary embodiment of the invention to provide a relocatable concrete armory vault.

It is a further object of an exemplary embodiment of the invention to provide a relocatable armory vault comprising metal fiber reinforced concrete.

It is a further object of an exemplary embodiment of the invention to provide a concrete enclosure comprising an outer room and an inner room.

It is a further object of an exemplary embodiment of the invention to provide a concrete enclosure comprising both a vault area and a distinct vestibule area.

It is a further object of an exemplary embodiment of the invention to provide a relocatable concrete armory vault comprising a daygate and a vault door.

It is a further object of an exemplary embodiment of the invention to provide a relocatable concrete armory vault having insulation panels embedded in concrete.

It is a further object of an exemplary embodiment of the invention to provide modular concrete armory vault enclosures.

It is a further object of an exemplary embodiment of the invention to provide stackable concrete armory vault enclosures.

It is a further object of an exemplary embodiment of the invention to provide a relocatable concrete armory apparatus comprising a vault having recessed securing anchors.

It is a further object of an exemplary embodiment of the invention to provide a relocatable concrete armory vault apparatus comprising removable lifting cams.

It is a further object of an exemplary embodiment of the invention to provide a method of using removable lifting cams with a relocatable concrete armory enclosure.

It is a further object of an exemplary embodiment of the invention to provide a concrete armory vault apparatus having the security level of a permanent vault with the mobility of a temporary vault.

Further objects of exemplary embodiments will be made apparent in the following Best Mode for Carrying Out Invention and the appended claims.

The foregoing objects are accomplished in some exemplary embodiments by a relocatable concrete armory vault enclosure comprising a metal fiber reinforced concrete. The concrete has a compressive strength of at least 15,000 psi. The enclosure comprises an outer vestibule room adjacent an interior vault room separated by an interior wall. The vault is bounded by the interior wall, roof, floor, back wall, and side walls. A vestibule door provides an entrance to the vestibule from an area outside the enclosure. A steel vault door is movably mounted to the interior wall and opens into the vestibule. A Dutch daygate door is also mounted to the interior wall. The daygate is located interiorly of the vault door and opens into the vault. Insulation panels are mounted to the enclosure by having a surface portion thereof embedded in concrete. The inner surface of the insulation panels is flush with an interior concrete surface of the enclosure. Removable lifting cams are mountable to the enclosure to enable the enclosure to be lifted and moved. Plural concrete armory vault enclosures can be stacked or positioned side by side.

As will be appreciated, the foregoing objects and examples are exemplary and embodiments need not meet all or any of the foregoing objects, and need not include all or any of the exemplary features described above. Additional aspects and embodiments within the scope of the claims may be devised by those having skill in the art based on the teachings set forth herein.

BRIEF DESCRIPTION OF DRAWINGS

FIG. 11B shows interior insulation in the ceiling of an enclosure.

FIG. 17 shows a connection between a wall and a slab.

BEST MODES FOR CARRYING OUT INVENTION

Figure 1:
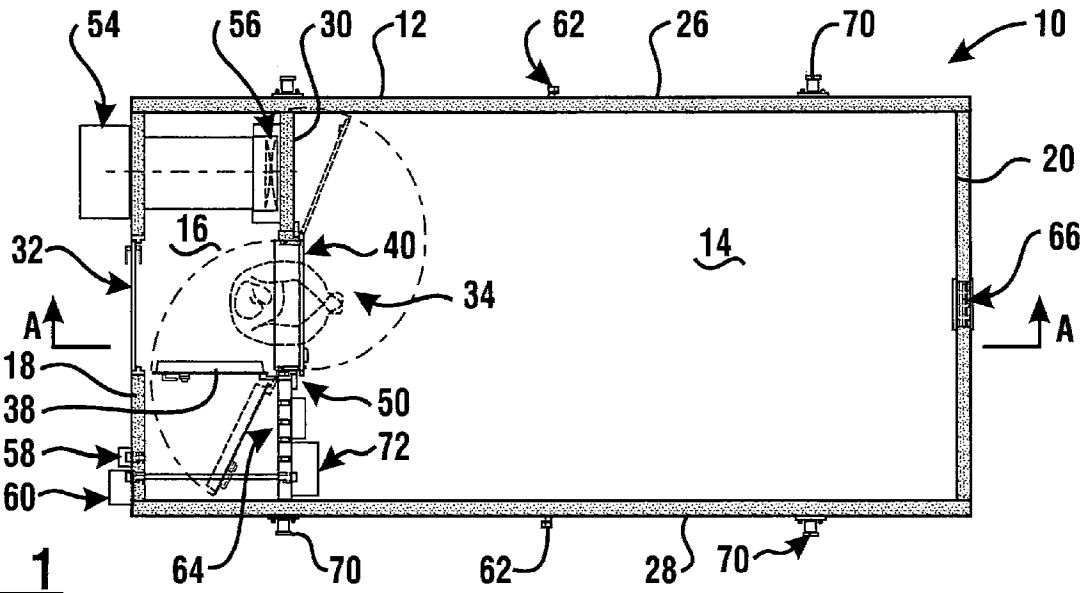
FIG. 1 shows a plan view of an exemplary armory vault apparatus.
Figure 2:
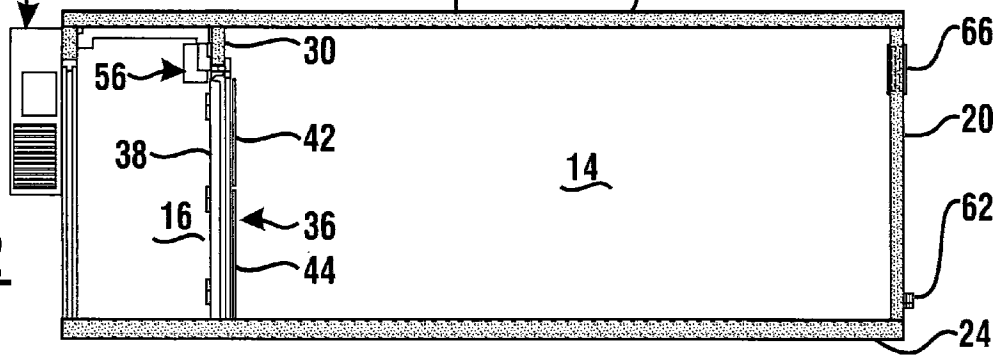
FIG. 2 shows a side view of the apparatus of FIG. 1.

Referring now to the drawings and particularly to FIGS. 1 and 2 there is shown therein a relocatable concrete armory vault apparatus of an exemplary embodiment, generally indicated 10. The exemplary apparatus can serve many purposes as discussed later, including the secure enclosure of items such as military weapons. The exemplary apparatus can provide the security level of a permanent vault with the mobility of a relocatable vault. Thus, the exemplary apparatus can be used in relocation applications. However, it should be understood that the apparatus may also be used in mobile, portable, temporary, deployable, and permanent applications.

FIG. 1 shows a top view of the exemplary armory vault apparatus 10. FIG. 2 shows a side view of the armory vault apparatus 10 taken along A-A of FIG. 1.

The exemplary relocatable apparatus 10 of FIGS. 1 and 2 includes a concrete housing or enclosure 12. The concrete enclosure 12 includes therein a vault section or portion 14. The concrete enclosure 12 also includes therein a vestibule section or portion 16. The exterior of the enclosure 12 has six wall panels, i.e., front wall 18, rear wall 20, top wall or roof 22, bottom wall or floor 24, and side wall panels 26, 28. The armory enclosure 12 can be prefabricated and then transported to the site of vault usage. Alternatively, the enclosure can be assembled on site.

The exemplary concrete enclosure 12 includes two sections, i.e., both a vault section 14 and a vestibule section 16. However, it should be understood that other exemplary concrete enclosures may have greater or fewer sections. For example, an enclosure may include three distinct sections or only one single section.

Figure 3:
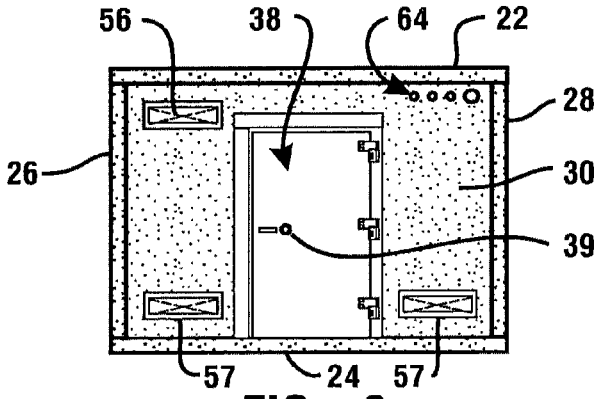
FIG. 3 shows an inside view of the apparatus of FIG. 1.
Figure 4:
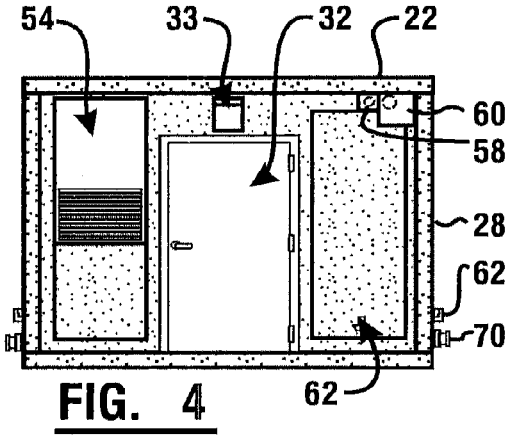
FIG. 4 shows a front view of the apparatus of FIG. 1.
Figure 5:
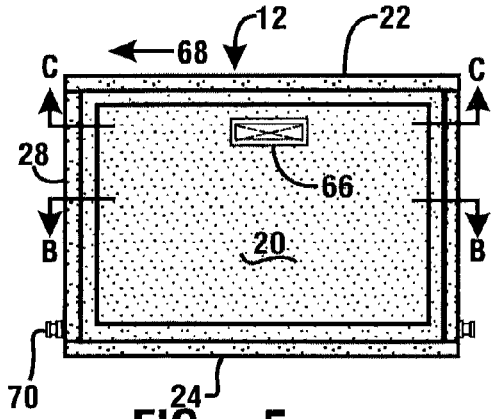
FIG. 5 shows a rear view of the apparatus of FIG. 1.

FIGS. 3, 4, and 5 also show views of the armory vault apparatus 10. FIG. 3 shows an inside vestibule view. FIG. 4 shows a front view of the enclosure 12. FIG. 5 shows a rear view of the enclosure 12.

The vestibule 16 comprises an enclosed chamber or passage or room. The vestibule 16 is located in the armory enclosure 12 adjacent to the vault 14. The area in the vestibule 16 is separated from the area in the vault 14 by a dividing wall or interior wall 30. The armory enclosure 12 has mounted thereto an outer vestibule door 32 (or exterior door or front door). The exterior vestibule door 32 can be hinged in supporting connection with a frame which extends in the front enclosure wall 18. The vestibule door 32 can comprise a steel door.

The vestibule 16 provides protection to people from the outside elements such as inclement weather. For example, a soldier may be assigned to work within the vault to check weapons in and out. Soldiers waiting to receive or return weapons from/to the vault can stand in the vestibule outside of the elements.

The vestibule 16 also provides protection to the vault door from the external weather, elements, and other conditions. Some alternative apparatus embodiments that include a weather-resistant vault door can be without a vestibule.

Of course the vestibule and the vestibule door also provide an additional level of security to the vault. The vestibule 16 can also be used for other purposes, including the storage therein of items that do not require the higher security level provided by the vault.

The interior wall 30 has an opening 34 providing passage between the vestibule 16 and the vault 14. The interior wall 30 has mounted thereto a frame which supports double door arrangement 36 comprising a primary solid vault door 38 and a secondary non solid door 40.

The vault door 38 is movable to open/close the interior wall opening 34. In an exemplary arrangement, the vault door 38 comprises steel, has a combination controlled lock mechanism 39, and has a Class 5 construction rating. It should be understood that in other embodiments other vault door materials and locking mechanisms can be used. For example, other vault door embodiments may use features from a mechanical key lock, an electronic lock, biometric recognition, or combinations thereof.

The secondary door 40 can comprise a Dutch door, sometimes referred to as a Dutch "day gate." For purposes hereof, a daygate is generally an open grille type of door enabling a person to see through it. Air can flow through the openings in the grille. The exemplary daygate has independently movable upper and lower portions.

Figure 6:
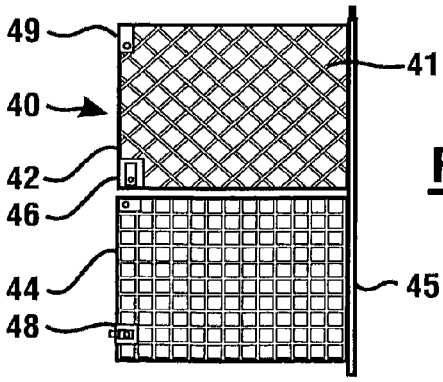
FIG. 6 shows an exemplary daygate.

FIG. 6 shows an exemplary daygate 40 as viewed from its vault side. The daygate grille 41 comprises a metal screen or mesh. The metal grille 41 is of a thickness and strength to prevent a person from physically removing (e.g., pushing out) the grille from the remainder of the door. The openings created by the grille configuration are too small a size for a person to pass through. In some arrangements the openings in a daygate mesh can be even too small for a person's finger to pass through.

The daygate 40 is split horizontally into two separately hinged movable doors (or gates). That is, the daygate comprises an upper gate 42 and a lower gate 44. The two gates 42, 44 can be moved individually or together (singularly) as a combined unit.

The daygate 40 has at least one first latch arrangement 46 thereon enabling the gates 42, 44 to be locked/unlocked to/from each other. Both gates 42, 44 can move (e.g., rotate) about a common hinge axis 45 as a single unit when they are latched or connected together. It should be understood that the upper 42 and lower 44 sections of the daygate 40 may be of equal vertical length. Alternatively, one daygate section can be vertically longer (in height) than the other. Additionally, a daygate can comprise more than two gates.

The daygate 40 has at least one second latch arrangement 48, 49 thereon enabling one of the gates (e.g., the lower gate 44) to be secured or locked to the interior wall 30. The latch arrangements 46, 48 can each comprise a hand operated sliding lock mechanism. The latch arrangements 46, 48 are located on the vault side of the daygate 40 to limit access thereto to a person in the vault.

The daygate 40 can have a key lock mechanism 50 associated therewith located on the vestibule side of the daygate (FIG. 1). Thus the daygate 40 can have manual inner latch locks 46, 48 and an outer key lock 50. The person working in the vault may also have access to other protection features, including an emergency alarm activation switch or button.

The daygate 40 when fully closed enables people on both sides of the daygate to see through it. During weapons transfer, the upper section 42 of the daygate can be left open to enable the passing of a weapon between the person working in the vault 14 and a person (e.g., soldier) in the vestibule 16. With the upper gate 42 open and the lower gate 44 closed, a person is still hindered from traveling between the vestibule 16 and the vault 14.

A portion of the daygate 40 can also have a distinctly sized opening or slot therethrough, such as a weapons slot. The slot may be horizontal or vertical configured. The weapons slot has a predetermined area that is sized large enough to pass a particular weapon therethrough. Use of the weapons slot enables both the top and bottom gates of a daygate door to remain fully closed and securely locked from the inside while still allowing the transfer of weapons between the vestibule and the vault. A weapons slot opening of a predetermined size can serve the transfer ability needed for a weapons cache in the vault yet maintain vault security.

A daygate can use different sized weapon slots. For example, upper gates having the same outer dimension can each have a different sized weapon slot. The upper gates can be changed on the daygate so that the selected slot corresponds to the weapon to be handled in the vault. A daygate can also have structure (e.g., a shelf, latch, strap, etc.) for temporarily supporting or holding an item (e.g., a rifle) while it is being transferred between the vestibule and the vault.

It should be understood that other secondary doors instead of a daygate can be used. For example, a substantially solid door may be used. The solid door can support a carrier that is movable on a track or rails. The carrier can be moved by hand through the door between the vestibule side and the vault side. The vault end of the carrier can be vertically closed to prevent viewing from the vestibule into the vault. Thus, persons on the vestibule side of the solid door are able to receive/return weapons but are prevented from viewing into the vault (which may hold classified information).

The vault can contain a display monitor linked to a camera in the vestibule. The monitor allows vault workers to view the interior of the vestibule. The use of a solid door and camera arrangement enables the transfer of items while enhancing the security of material in the vault and the safety of persons working therein. For reasons previously discussed, other substantially solid doors can have one or more weapons slots.

In an exemplary embodiment, the vault door 38 is intermediate or between the vestibule door 32 and the daygate door 40. Further, the vault door 38 is hinged to swing open into the vestibule 16, whereas the daygate 40 is hinged to swing open into the vault 14. However, it should be understood that other double door arrangements can be used in alternative embodiments. For example, a daygate can be located between the vestibule door 32 and the vault door 38, with the daygate opening into the vestibule 16 and the vault door opening into the vault 14. Also, both a vault door and a daygate may be hinged so that they both open into the vestibule.

The vault door 38 provides the primary door security to the interior of the vault, whereas the vestibule door 32 and the daygate door 40 each provide a secondary level of door security to the vault. In an exemplary arrangement, a person trying to get into the vault 14 of a closed and locked armory enclosure 12 has to first get through a steel vestibule door 32 and then get through each of a steel vault door 38 and a steel daygate door 40 in order to gain access items stored in the vault 14.

In an exemplary embodiment, the doors 32, 38, 40 also have sensors and alarms associated therewith. The sensors can detect door opening movement, vibration in a door, temperature increase (e.g., the reaching of a predetermined temperature), and/or sound increase (e.g., the reaching of a predetermined decibel level), etc. Thus, an improper attempt to access the vault via the doors results in an alarm being tripped. The alarms can be audible and/or visual. Alternatively, the alarms may be of the silent type. The alarms and/or sensors further add to the security of the armory apparatus.

The walls 18, 20, 22, 24, 26, 28 of the exemplary armory enclosure 12 are made from a high strength metal fiber-reinforced concrete mix. The concrete material is preferably of high strength/low weight. The high strength concrete is sufficiently strong, yet light enough to withstand use in mobile applications. In an exemplary embodiment the concrete of the apparatus has a compressive strength ranging from 15,000 to 25,000 psi (pounds per square inch). An exemplary strength range is 17,500 to 25,000 psi. It should be understood that for purposes of claim support the concrete can have a strength of at least N psi, where the numbered value N is any number between (and including) 15,000 and 25,000. In exemplary embodiments, rebar (e.g., steel rods) and/or other reinforcing structure may also be provided in the concrete. Other apparatus embodiments can have strength ranges greater than 25,000 psi. Alternative apparatus embodiments can have strength ranges lower than 15,000 psi but also have thicker walls.

In an exemplary embodiment, the concrete enclosure meets the Department of Defense's (DoD) requisite level of attack resistance for pre-engineered magazines. The high strength concrete enables a two-inch thick enclosure wall panel to have a UL Class M construction rating for a 15 minute attack standard. Thus, the exemplary enclosure has at least 15 minutes access resistance to chisels, torches, and the like. As a result of the provided resistance, the exemplary high strength concrete structure can eliminate previous reliance on quarter-inch steel armory vaults, which could be readily cut through with a torch. The exemplary enclosure meets the U.S. Government certification designation standards of AR190-11 (DoD), AV 2737 (GSA), and ballistics test (Dept of Justice).

The exemplary concrete enclosure 12 also has very low water porosity and water absorption capabilities. Because the concrete is generally not porous compared to conventional concrete, water can be prevented from entering the interior of the vault through the concrete. Thus, the concrete vault 14 is suitable for holding military weapons, such as rifles.

For purposes of further minimizing water infiltration, the six wall panels 18, 20, 22, 24, 26, 28 that make up the exterior of the enclosure 12 can be joined with suitable water-resistant sealing elements between them. For example, the wall panels can be caulked or otherwise sealed to prevent the infiltration of water through the seams where the walls are joined. This sealing feature in combination with the low water absorption of the concrete further minimizes the risk of water infiltration into the enclosure 12.

Because the exemplary armory enclosure 12 is substantially imperviousness to water, it can be set on gravel or directly on the ground. That is, the armory enclosure does not require a separate concrete pad or other supporting structure. Nevertheless, the armory enclosure can still be set on a concrete pad for additional support and stability with regard to sites having varying soil conditions. The concrete feature of the enclosure can also eliminate corrosion problems associated with a metal armory enclosure.

Also shown in FIGS. 1-5 are a heating and air conditioning system. The exemplary system includes a HVAC unit 54 externally mounted to an enclosure wall (e.g., front wall 18). The HVAC unit 54 is connected via a duct to an HVAC port or vent 56. A telephone and/or communications box 58, a central power supply box 60, and at least one electrical receptacle 62 are mounted to the exterior of the front wall 18. Features of the exemplary embodiment including conduit penetrations 64 in the dividing wall 30, at least one air exhaust unit 66 in the rear wall 20, the roof wall 22 being sloped downward in the direction of Arrow 68, exterior mounted lifting cams 70, and electrical/communication control panels 72 in the vault are also shown.

The exemplary vault exhaust unit 66 includes an exhaust fan 65 and an exhaust vent 67. The vault exhaust unit 66 may be located in the rear wall 20 of an enclosure 12 at a position other than that shown in FIGS. 1 and 5. For example, instead of being centrally located in the rear wall 20, the vent/outlet 66 may be positioned closer to one of the side wall 26, 28. The rear wall 20 can also have more than one vent 66, which may be manually closed/opened.

The exemplary HVAC unit 54 includes a dehumidifier. The HVAC unit 54 is operative to blow conditioned air into the vault area 14. The treated (heated or cooled) air that is forced into the vault 14 can flow around stored articles. The air can then exit the vault into the vestibule through one or more manually closeable vents 57 located in the dividing wall (30). For example, the vents 57 can be located in a lower portion of the dividing wall 30. The air circulation helps to control temperature and humidity in the vault area. The level of moisture in the vault air can be finely controlled via thermometer and humidity controls. It should be understood that the HVAC system can likewise enable the condition of the air in the vestibule area to also be controlled.

An air exhaust unit 66 can transfer air out of the vault and into the ambient environment outside of the armory enclosure in the exemplary embodiment. An exhaust fan 65 can be operated independently of or in combination with the HVAC unit 54 to help control the internal climate of the vault. The operational use of the HVAC unit 54, dividing wall vents 57, exhaust fan 65, and/or exhaust vents 67 can be related to (or dependent on) the open or closed positions of the outer vestibule door and the vault door. Thus, the armory enclosure 12 includes a manually operable temperature and humidity control system providing air flow management to the entire interior of the enclosure.

In an exemplary armory enclosure, an HVAC unit 54 is mounted on an upper portion of the exterior face of the front enclosure wall 18, a conditioned air entry vent 56 connects the HVAC unit 54 directly to the vault interior 14, dividing wall vents 57 are horizontally spaced in a lower portion of the dividing wall 30, an exhaust fan 65 is mounted on/in an upper portion of the rear enclosure wall 20, and the exhaust vent 67 passes through an upper portion of the rear wall 20.

Figure 7:
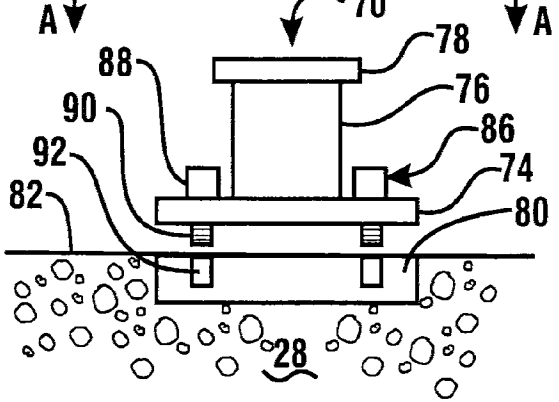
FIG. 7 shows a removable lifting cam.
Figure 12:
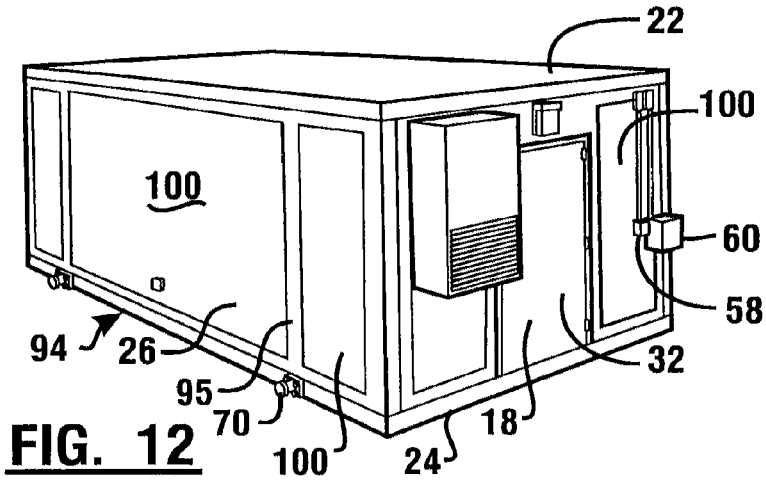
FIG. 12 shows an angled view of an alternative armory apparatus.
Figure 13:
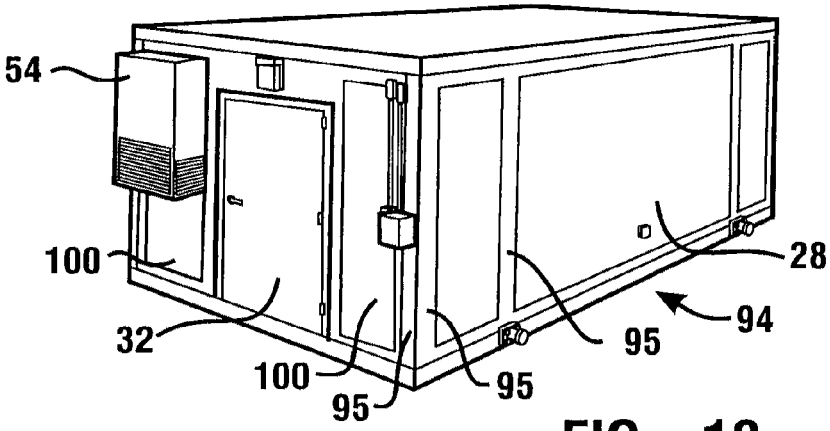
FIG. 13 shows another angled view of the apparatus of FIG. 11.
Figure 14:
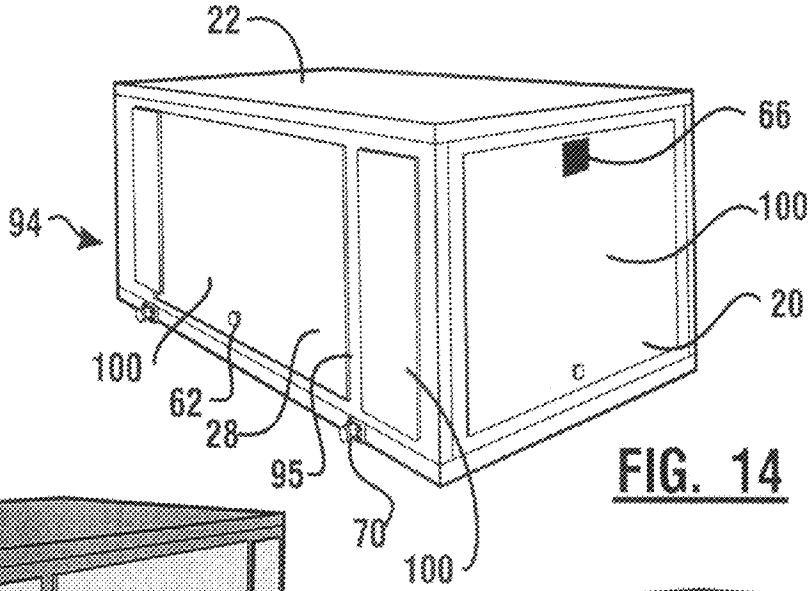
FIG. 14 shows a further angled view of the apparatus of FIG. 11.

FIG. 7 shows a cutaway top view of an exemplary removable lifting flange or cam 70. The cam 70 is being viewed looking downward through a cross section of the side wall 28. The lifting cam 70 is attachable to the side wall 28 of the enclosure 12, such as at a lower position adjacent to the bottom floor slab 24. Several lifting cams can be removably fastened to the same side wall 26, 28. In other enclosure arrangements, additional lifting cams 70 can be attached to the floor slab 24. In an alternative arrangement, lifting cams 70 are only attached to the floor slab 24 (FIGS. 12-14). The cams 70 enable the entire enclosure 12 to be integrally lifted as a one-piece single unit.

Figure 8:
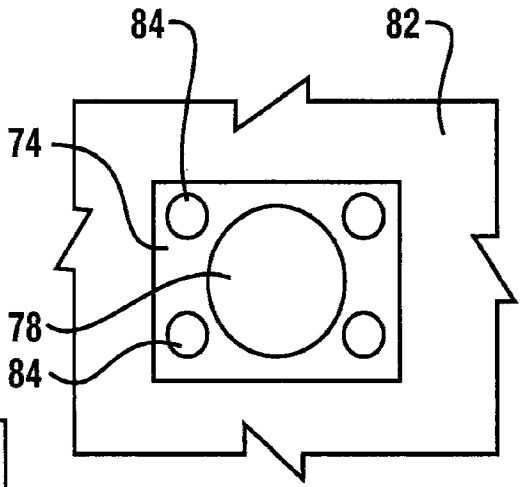
FIG. 8 shows a front view of the lifting cam of FIG. 7.

FIG. 8 shows a sectional view taken along section A-A of FIG. 7. The outer face of the lifting cam 70 is being viewed from a side of the enclosure 12. An outer surface area 82 of the side wall 28 that is adjacent the cam 70 is also shown.

Each exemplary lifting cam 70 comprises an inboard metal cam plate 74 attached to (e.g., mechanically, welded, etc.) or integral with (e.g., unitary) an outwardly projecting cylindrical metal piece 76. The cam cylinder 76 has an outboard circumferential lip 78.

Each cam plate 74 can be mechanically fastened to a corresponding metal housing plate 80 with a number of (e.g., four) bolts 86 that can be removed and reused. The bolts 86 pass through openings 84 in a cam plate 74. Each (e.g., four) housing plate 80 (or cam mounting fixture) can be individually embedded in and unitary with the concrete of an enclosure side wall 26, 28 at a respective mounting location at (or near) an outer side surface 82 of the side wall. The exterior surface of each housing plate 80 can be flush with the surrounding exterior surface 82 of the side wall to which it is attached. In FIG. 7 the exterior surface 82 is that of side wall 28.

The cam bolts 86 can comprise a head portion 88 and a threaded portion 90. The threaded male portion 90 of each bolt 86 is sized to screw into a corresponding respective female threaded recess portion 92 in a housing plate 80. Washers can also be used. The cam bolts 86 can fasten the lifting cams 70 to the side walls 26, 28.

In an exemplary lifting cam arrangement, each side wall 26, 28 has two horizontally aligned housing plates 80. The plates 80 are located at the same positions on each side wall. Four lifting cams 70 are respectively fastened to the four housing plates 80. Each cam plate 74 has four openings 84 for four bolts 86. Each threaded bolt portion 90 passes through a plate opening 84 and into a threaded housing plate hole 92.

Cams 70 fastened to the exterior of the armory enclosure 12 can be engaged to hooks or loops on a wire sling or chain, which in turn is connected to a lifting device, such a crane. The lip 78 of a lifting cam 70 can prevent a loop from slipping off of the cam. Thus, the entire exemplary armory enclosure 12 can be moved or lifted through the lifting cams 70.

After the vault is moved into a desired position, the cam bolts 86 can be removed so that the cam plates 74 are no longer connected to a housing plate 80. That is, removed cams 70 are no longer attached to a side wall 26, 28 of the enclosure 12. A removed cam 70 can again be reused for attachment to a housing plate 80 of an armory enclosure 12. Thus, the removable lifting cams 70 are reusable. In an exemplary arrangement, several armory enclosures 12 each have housing plates 80 of the same size. This standardized arrangement enables each correspondingly sized lifting cam to be used with any of these enclosures.

In an exemplary embodiment, because of the strength of the concrete, only four lifting cams 70 are needed to lift an (empty) armory enclosure. However, it should be understood that in other embodiments more than four lifting cams may be used. Also, in other embodiments, the armory vault may be constructed so as to be lifted and transported either partially or fully loaded.

As previously discussed, the cams 70 can be attached to the side walls 26, 28. However, lifting cams 70 can also be attached to sides of the floor slab 24.

The use of the exemplary removable lifting cams 70 provides the ability to place another structure (e.g., another enclosure 12) in abutting adjacent relationship with (e.g., right up against) the armory enclosure 12. That is, with the lifting cams 70 removed, the enclosure 12 can be positioned closer to another structure than would be permitted if the lifting cams remained attached. It should be understood that removing only the lifting cams 70 from one side of an enclosure 12 (or removing only one lifting cam) may also provide the ability to place the enclosure 12 against or closer to another adjacent structure.

As previously discussed, an arranged set (e.g., four cams) of lifting cams 70 can be located at a bottom portion (e.g., floor slab, side wall's lower portion) and/or a top portion (e.g., side wall's upper portion) of an armory enclosure 12. The use of upper positioned lifting cams 70 enables an enclosure 12 to be positioned in a more closely spaced relationship with adjacent structures that are of a lesser height. That is, higher positioned cams 70 would not interfere with the armory enclosure 12 being placed along a side of a shorter structure (relative to the cam height).

An exemplary method includes installing lifting cams to an armory enclosure; lifting the enclosure via the cams; transporting the enclosure to a remote location; lowering the enclosure in place; and removing the lifting cams from the enclosure. The cams may be removed after the enclosure has been lowered into its work site. Thus, an exemplary method includes a sequence of installing lifting cams to an armory enclosure; lifting the enclosure via the cams onto a transport vehicle; transporting the enclosure to a remote location via the transport vehicle; lifting the enclosure via the cams from the transport vehicle; lowering the lifted enclosure via the cams into place at a work site; and then removing the lifting cams from the lowered enclosure. Alternative methods can include removing the cams before initial lowering of the enclosure. For example, an enclosure may be removed from a transport vehicle in a manner (e.g., sliding on rollers) not including lifting thereof.

Individual cam removal can include loosening the fastening bolts, removing the bolts, and removing the cam from a housing plate. Further steps can include installing lifting cams to each side of an enclosure slab; and removing lifting cams from at least one side of the enclosure. Installing lifting cams can include installing two cams to each enclosure side of a floor or roof slab. Further steps can include positioning one enclosure 12 against another enclosure 12 in a side-by-side, stacked, or end-to-end arrangement, as discussed in more detail later.

In exemplary embodiments the interior temperature and humidity of the area inside the enclosure 12 can be manually or automatically controlled. At least the vault section 14 is insulated. The insulation is provided through one or more interior and/or exterior mounted insulation panels. These insulation panels can be cast-in with the concrete wall panels 18, 20, 22, 26, 28 as these wall panels are being formed. Thus, an insulation panel can be embedded to an enclosure wall surface. The bottom (floor) wall 24 and the dividing wall 30 can also have interior and/or exterior insulation.

An insulation panel can comprise a single layer of a single material. Alternatively, an insulation panel can comprise a plurality of materials and have a plurality of stacked material layers.

Figure 9:
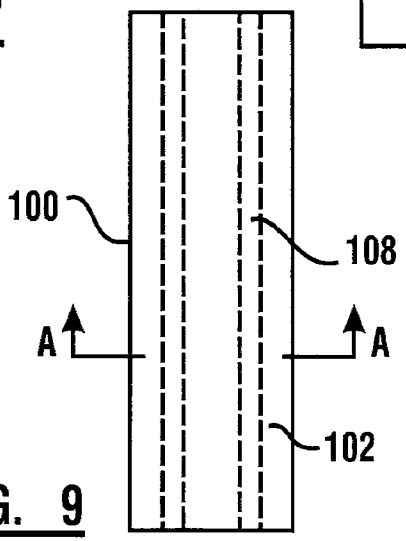
FIG. 9 shows an insulation panel.
Figure 10:
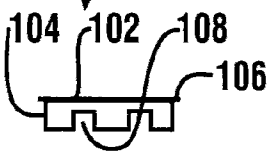
FIG. 10 shows a side view of the panel of FIG. 9.

FIG. 9 shows an exemplary insulation panel 100. FIG. 10 shows a sectional side view of the insulation panel 100 taken along section A-A of FIG. 9. The insulation panel 100 comprises at least two layers of materials. In an exemplary embodiment, an outside material layer 102 is affixed (or adhered) to an inside material layer 104. The outer material 102 may include Kemlite™, which is comprised of a hard plastic UV resistant film. The inner material 104 includes styrofoam. Thus, the insulation panel 100 has an exterior facing Kemlite™ film side 102 and a (concrete facing) interior styrofoam side 104. The Kemlite™ film side 102 can act as a surface cover for the insulation panel 100. Of course other exterior panel films, such as sheets, spray on materials, or other structures may be used in other embodiments.

The inner face of the styrofoam 104 is the primary surface exposed to concrete. The concrete material can be cast around the styrofoam 104 in an exemplary manufacturing embodiment. The metallic fibers or filler in the concrete can mechanically engage the styrofoam 104 to hold the insulation panel 100 in place in the enclosure wall. Of course in other embodiments other approaches and materials may be used.

Prior to casting a concrete wall panel, insulation panels 100 can be placed with the Kemlite™ film side facing downward at predetermined positions in a mold. The panel 100 may have a circumferential Kemlite™ film extending edge lip 106, as shown in FIG. 10. Concrete can then be poured on top of the insulated panels 100. The concrete then sets producing a wall panel containing insulated panels 100 embedded thereto. Thus, the outward surface of the Kemlite™ film 102 can be flush with the surrounding concrete wall surface, whether the wall surface is an interior or exterior enclosure surface.

In an exemplary embodiment, large elongated grooves 108 are cut into the styrofoam face of each insulated panel 100. In forming the panels poured concrete fills these grooves 108. The grooves create a larger styrofoam-to-concrete contacting surface area, which provides for a stronger bond between an insulated panel 100 and the concrete. The grooves 108 are generally configured so that they extend vertically when the insulated panel 100 is situated on a vertical wall of a completed enclosure. The concrete that sets in the grooves 108 forms vertically spaced beams or ribs that act to provide additional support for the concrete walls. Of course this approach is exemplary and in other embodiments other approaches may be used, including the forming of horizontally spaced beams or ribs.

Insulation panels can be located on an interior surface of an armory enclosure. The insulation panels face an interior area of the enclosure. For example, the top interior (ceiling) wall 22, front wall 18, rear wall 20, and side interior walls 26, 28 of the enclosure 12 can comprise one or more insulated panels. As previously discussed, an interior facing insulation panel can be mounted flush with its surrounding concrete interior wall surface. The interior concrete wall surfaces can be painted a reflective color (white) to enhance lighting and provide a bright clean working environment. Interior insulation panels located on the interior walls and the interior ceiling can similarly have a reflective (white) surface.

Figure 11A:
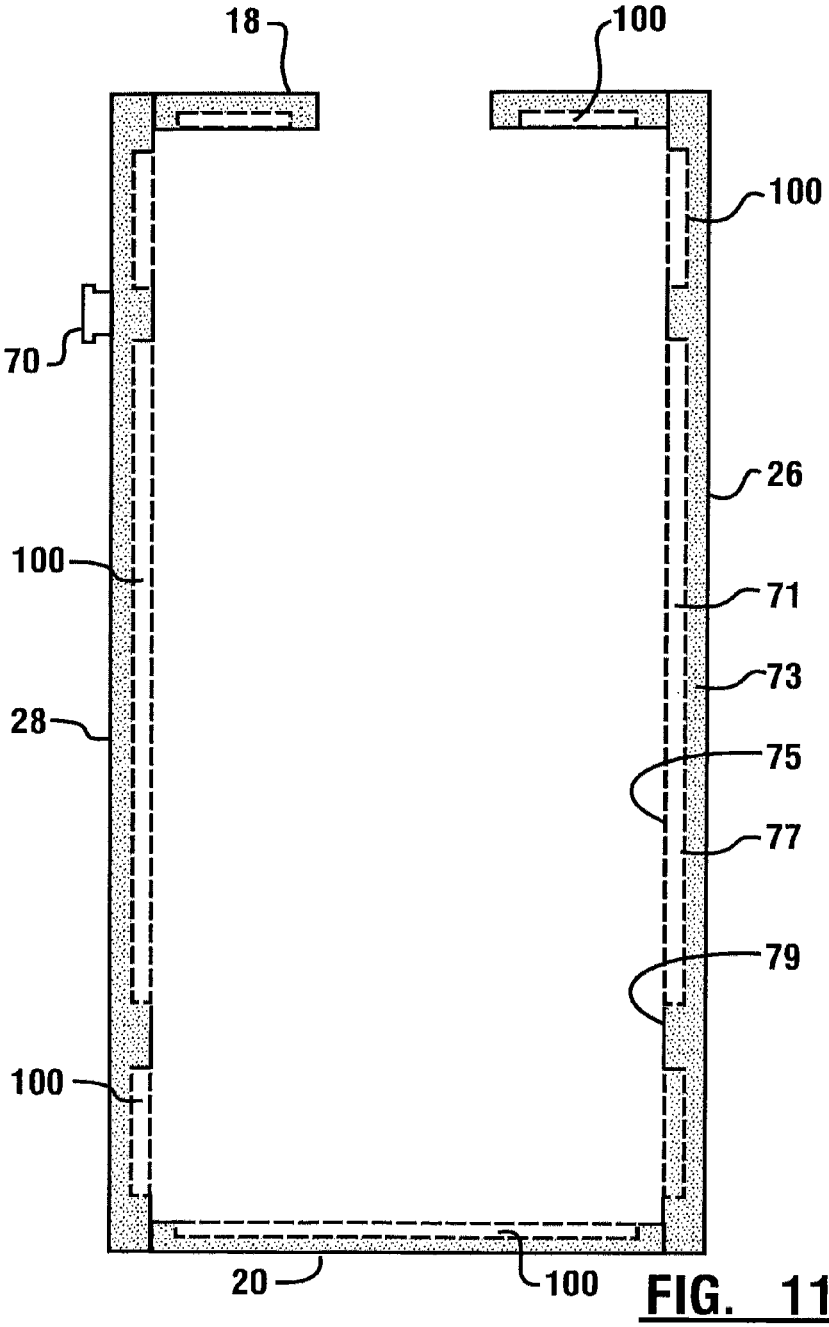
FIG. 11A shows interior insulation in walls of an enclosure.

FIG. 11A shows a cross sectional view of insulated walls of a lower portion of the enclosure 12 taken along section α-B of FIG. 5. The view is taken near the mid section of the enclosure 12, with an upper portion of the enclosure cut away. The angle of the view is similar to that in FIG. 1. However, the view looks downward only through the front wall 18, back wall 20, and side walls 26, 28. For clarity, the dividing wall 30, the area of the vestibule door 32, and other enclosure features have not been shown.

As shown, the walls 18, 20, 26, 28, which are exposed to the environment exterior of the enclosure 12, include interior insulation. These four walls each similarly have a concrete portion and at least one insulation portion. Each insulation portion has an insulation panel 100. The boundary surfaces of the insulation panels 100 are represented by broken lines in FIG. 11A. For simplicity, the side wall 26 will be further described.

Insulation panels 71 are embedded in a concrete portion 73 of the side wall 26. An insulation panel 71 may be fixed in concrete on five of its six sides. As can be seen, each insulation panel 71 has an inner free surface 75 facing away from the concrete wall, and an embedded outer surface 77 facing toward the concrete wall. A panel free surface 75 forms part of an interior wall surface. Thus, an insulation panel's free surface 75 can be exposed to the interior environment of the enclosure 12. Likewise, a concrete free surface 79 also forms part of an interior wall surface. The free surfaces 75, 79 together form the interior surface of each respective enclosure wall 18, 20, 26, 28.

The interior insulation wall surfaces 75 formed by the insulation panels are shown flush with the interior concrete wall surfaces 79 formed by the adjacent concrete. Thus, the enclosure 12 can have substantially smooth interior walls. That is, even though the inner surface of each wall 18, 20, 26, 28 can be formed of different materials or structure (concrete and panels), it can still be even or level. FIG. 11 shows four interior wall surfaces, each being substantially straight in both the vertical and horizontal directions. The concrete portion of a wall is thicker in the areas adjacent a lifting cam 70.

FIG. 11B shows a cross sectional view of an upper portion of the enclosure 12 taken along section C-C of FIG. 5. The view looks upward through the front wall 18, back wall 20, dividing wall 30, and side walls 26, 28 toward the roof slab 22 of the enclosure 12. The insulated walls 18, 20, 26, 28 were previously described with regard to FIG. 11A.

The roof 22 has interior insulation panels embedded in concrete thereof. For ease of understanding and consistency, the insulation panels will again be represented by reference numeral 100. The boundary edges of the insulation panels 100 are represented by broken lines in FIG. 11B. The Kemlite™ film material 102 in the ceiling 22 faces inward into the vault interior. As can be seen, the ceiling panels 100 are spaced from each other by the concrete portion 101 of the ceiling 22. That is, roof concrete is intermediately located between and acts to separate the panels 100 from each other. The inner surfaces of the insulation panels 100 can be flush with the inner intermediate concrete surfaces 101 of the ceiling 22.

The roof slab 22 covers both the vault area and the vestibule area. In the FIG. 11B embodiment, five similarly sized insulation panels 100 are part of the vault ceiling. Another similarly sized insulation panel 100 is part of the vestibule ceiling. The interior ceiling surface has concrete 101 intermediate and flush with the embedded insulation panels 100. It should be understood that different numbers and arrangements of roof insulation panels can be used in other embodiments, and they can be identically dimensioned or have varying shapes and sizes.

FIGS. 12-14 show different angled exterior views of an alternatively configured armory apparatus 94. The apparatus 94 is similar to the apparatus 10 except for alternatively located components, such as the exterior mounted communications box 58 and central power supply box 60. Thus, all of the previously discussed apparatus features need not be repeated.

FIG. 12 shows a first (left) side wall 26, front wall 18, and roof 22. FIG. 13 shows the front wall 18, roof 22, and second (right) side wall 28. FIG. 14 shows the rear wall 20, roof 22, and second side wall 28. Removable lifting cams 70, exterior concrete wall surfaces 95, and differently sized exterior insulation panels are also shown in the FIGS. 12-14. A lifting cam 70 can be attached to the concrete floor slab 24 as shown, or alternatively to an exterior surface 95 of the concrete side walls 26, 28 as previously discussed (e.g., FIG. 5). For ease of understanding and consistency, the insulation panels are again represented by reference numeral 100.

In some exemplary arrangements, enclosure side walls are reversible. That is, a side wall is formed so that both wall surfaces thereof can face inward or outward. The side wall is formed with insulation panels embedded therein only on one side. However, depending on the armory needed, the side wall can be assembled with its insulation panel side facing either inward or outward. This enables the same generic side wall to be used for both enclosures requiring interior insulation and enclosures requiring exterior insulation. Furthermore, the same sized enclosure can be assembled insulation panel side of the side walls can be used to face inward or outward during assembly of an enclosure. The side wall can also have cam mounting fixtures on both of its sides.

Figure 15:
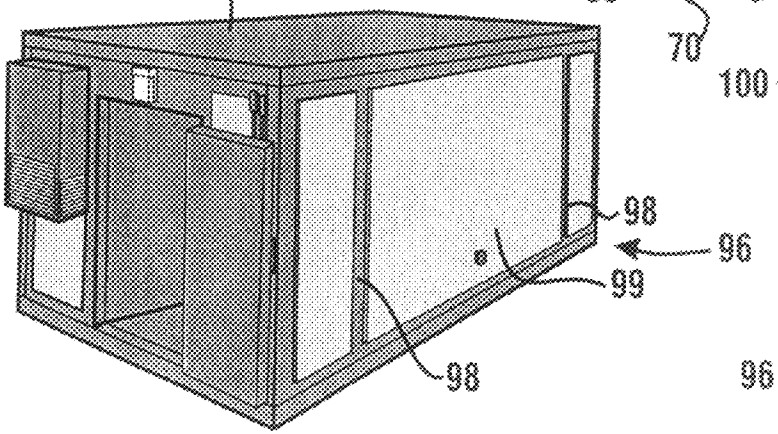
FIG. 15 shows a shading difference between exterior concrete surfaces and exterior insulation panel surfaces.
Figure 16:
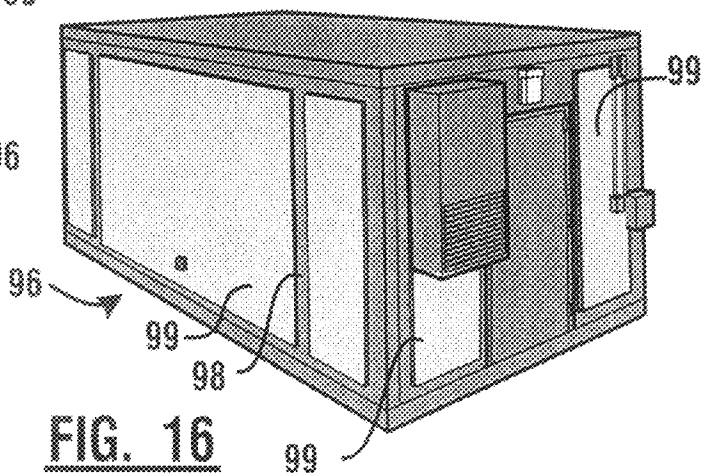
FIG. 16 shows an angled view of FIG. 14.

The exemplary relocatable concrete armory apparatus 94 can also be low maintenance. The concrete can be produced so that it does not require any painting. However, the concrete itself can be stained with a colorant. For example a dark brown colorant material may be applied to the exterior of an armory enclosure. The concrete may also be painted. The Kemlite™ film or other suitable panel cover, in addition to being UV resistant, can also be one of several different colors. The insulation panels may also be painted. FIGS. 15-16 show angled exterior views of an exemplary armory apparatus 96 with the exterior concrete 98 being of a different color (or shade) from the exterior insulation panels 99.

It should be understood that the outer appearance of an armory enclosure can also be fashioned to correspond to the usage of the vault. For example, in a military operation a (brown or green) camouflage color pattern can be present on the exterior surfaces of the concrete wall panels and insulation panels.

In an exemplary armory enclosure embodiment, the enclosure's vault area is at least four times larger than the enclosure's vestibule area. For example, a vault area can be approximately five times greater than its adjacent vestibule area. A vestibule size can be a function of the vault size. However, as previously discussed, in other arrangements the vestibule area of an enclosure can be the same size or even larger than the vault area. An armory enclosure can also be custom built for specific applications. Dimensions of an enclosure's vault section and vestibule section (if any) can depend on the particular armory mission required.

The exemplary armory enclosure 12 can have an exterior roof 22 surface that is substantially flat. Alternatively, as shown in FIG. 11B the outer roof 22 surface can have a slight slope 68 so as to facilitate water runoff. In an exemplary arrangement the enclosure roof is angled to have an inclined grade of approximately 1 inch between side walls 26, 28.

As previously discussed, insulation can be located at the interior and/or exterior wall surfaces of an armory enclosure to provide insulation. In an exemplary insulation arrangement for an armory enclosure 12, at least two spaced apart insulation panels 100 are mounted (e.g., embedded) at the interior surfaces of the front wall 18, side walls 26, 28, and vault ceiling 22. At least one insulation panel 100 is mounted at the interior surfaces of the rear wall 20 and vestibule ceiling. In the exemplary insulation arrangement, the bottom (floor) wall 24 and the dividing wall 30 do not have any insulation panels.

FIG. 17 shows an exemplary connection between two adjacent enclosure walls. The connection is between a vertically upstanding enclosure wall (i.e., one of the front wall 18, rear wall 20, sides walls 26, 28, and dividing wall 30) and a horizontally lying enclosure wall (i.e., one of the top 22 or bottom walls 24).

For purposes of an example, a connection between the front wall 18 and the roof slab 22 will be described. A metal connecting pins 110, such as a steel reinforcing rods, are securely set in concrete of the front wall 18. The pins 110 are fixed in the front wall 18. FIG. 11B shows a plurality of spaced pins 110 in the front wall 18 (and other walls).

There are several methods of placing or arranging a pin 110 in the front wall 18. For example, the pin can be directly placed in the concrete. Alternatively, the pin can first be placed in a sleeve or insert 112 associated with a lower pin (hairpin) anchor 111 prior to its placement in the (not yet hard) concrete. The insert 112 can be used to ensure that the pin has been inserted at a proper depth. Pin 110 has a lower end 114 and a free upper end 116 (i.e., the end opposite the end in concrete). In FIG. 17 a portion of the lower end 114 is hidden by the insert 112.

The roof slab 22 has a slot or opening 118 (e.g., corrugated sleeve) into which the pin upper end 116 is to extend. The roof slab 22 is set on the front wall 18. After the upper end 116 has been properly placed into a respective roof opening 118, which may include use of an upper pin (hairpin) anchor 119, then the opening 118 can be filled with a fastening material 120, such as epoxy grout and/or concrete, to secure the pin 110 to the roof slab 22. One of the roof wall 22 or front wall 18 can have a notch 122 for purposes of sealing or caulking the joint between the walls 18, 22. As previously, discussed sealing material can assist in preventing water from entering into the enclosure 12.

Although a front wall and roof wall connection has been described as an example, it should be understood that pins or other connecting structures can similarly be used to securely fasten other adjacent walls to each other. FIG. 11B also shows an exemplary arrangement of horizontally spaced pins 110 situated along the upper edges of a front wall 18, rear wall 20, side walls 26, 28, and a dividing wall 30. Of course other approaches and arrangements may be used.

In some embodiments metal attachment structures such as plates, angles or other anchor structures may be cast into concrete panels and other components for purposes of holding the components of the enclosure in assembled relation. Such structures may include suitable projections that extend in the concrete for anchoring purposes while leaving suitable attachment surfaces exposed outside the concrete. Such attachment surfaces may be positioned on interior surfaces of panels and other structures in areas where such panels are adjacent other panels and structures that are held together when the enclosure is assembled. Such exemplary panels may then be attached by connecting the metal attachment structures. This may be accomplished by welding the metal attachment structures together in fixed relation. Of course in other embodiments other fastening approaches may be used.

In some embodiments different approaches may be used for fastening panels and other components of the enclosure together. Different connections can be used to structurally secure different adjacent walls to each other. For example, the floor and side wall structures may be attached through welding metal attachment structures as previously described. Then after the bottom and side walls of the enclosure are fixed, the top may be attached with the pin structures previously discussed. This enables attachment of the structure other than the roof into an open structure which facilitates assembly by making more readily available illumination and ventilation for fastening operations such as welding. Once all the other structures are fixed, the roof is attached as previously described without the need to weld or fasten structures within the enclosure. This further facilitates assembly. Of course this approach is merely exemplary. Further, while permanent fastening of the components such as walls, floors and roof have been described, other embodiments may employ releasible fasteners to facilitate removal or replacement of certain components, or disassembly of all enclosure components. Numerous suitable approaches may be used.

In an exemplary enclosure embodiment, the structure of the front wall 18, rear wall 20, and side walls 26, 28 are, for example, about 4 to 6 inches in overall width or thickness, with an exemplary width of about 5 inches. However, in the exemplary embodiment only portions of these wall panels actually have concrete that is this thick. Other portions or segments of these wall panels are reduced to about two inches thickness to reduce armory enclosure weight. The thicker wall areas act like beams or ribs to provide rigidity to the entire concrete enclosure. FIG. 17 shows the roof slab 22 having a first thickness portion 124 (measured from exterior to interior surface) and a second thickness portion 126. Similarly, the front wall 18 has a first thickness portion 128 (measured from interior to exterior surface) and a second thickness portion 130. It should be understood that all of the enclosure walls can have varying thicknesses. Alternatively, some walls (e.g., interior dividing wall 30) may have a constant wall thickness.

Figure 18:
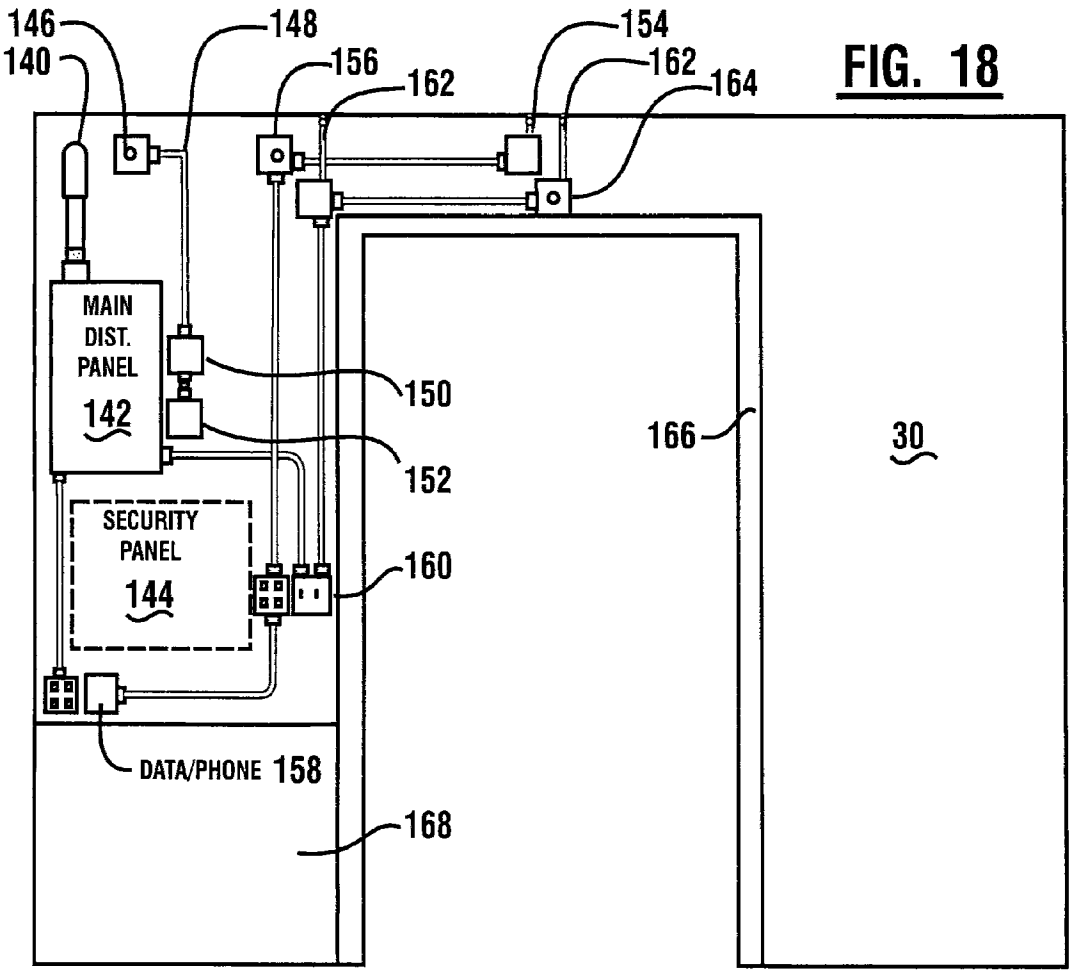
FIG. 18 shows components mounted on the vault side of an interior wall.

Further interior portions of an exemplary vault 14 will now be described. FIG. 18 shows an electric/alarm layout supported on the vault side of the dividing wall (30). The exemplary layout includes a main electric line in 140. The previously discussed electrical/communication control panels 72 can comprise an electric distribution panel 142 and a security panel 144. Also shown are a receptacle 146 to HVAC/outside, a conduit 148 from the HVAC unit, a thermometer 150 for temperature control, and a humidity control 152. The data/phone lines include a wire mold conduit 154, a junction 156, and a data/phone box 158. The lighting system includes on/off light switches 160 for exterior and interior lights, a wire enclosed in a conduit 162, and an emergency exit light 164. The vestibule 16 also has a ceiling light. An exterior light 33 is also mounted above the vestibule doorway (FIG. 4). The vault interior also has electric outlets and other assorted conduits and boxes for wiring. Of course these items are exemplary.

FIG. 18 also shows other features, including a door frame 166 for a vault door 38. A work desk 168 (with its upper level outlined) is further shown. A work desk can equip a vault worker with office supplies and tools. The desk 168 can also support a computer, bar code reader device, RFID reader device, etc. It should be understood that other vault interior embodiments may have other features and arrangements.

Figure 19:
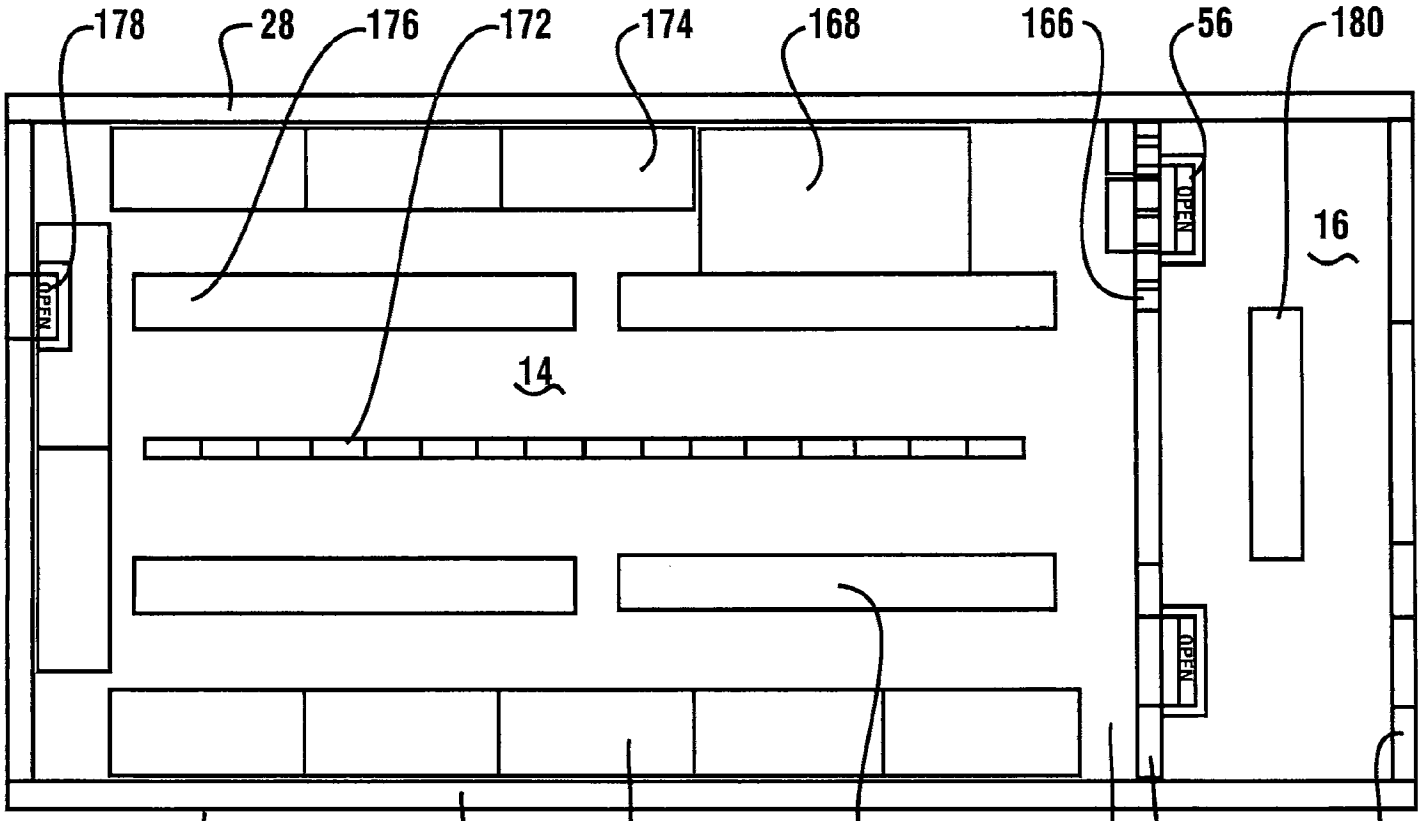
FIG. 19 shows an interior lighting and storage arrangement for an enclosure.

FIG. 19 shows a cross-sectional view of an exemplary enclosure 12 looking downward from the enclosure ceiling 170. Previously discussed enclosure structure comprising a front wall 18, rear wall 20, side walls 26, 28, and a dividing wall 30 are shown. A wiremold type wire conduit arrangement 172 attached to the vault ceiling is for electric/data/phone lines. The wiremold ceiling location prevents it from interfering with storage of items. The items can be openly stored in the vault 14. Alternatively items (e.g., rifles) can be stored in/on storage structures 174 located in the vault 14, such as gun racks, cabinets, etc. Vault ceiling lights 176 can provide ample lighting. The lighting fixtures and wire molding can be connected to and supported by insulation panels 100 and/or concrete that make up the ceiling 170. A vault door frame 166, vault desk 168, and a vault vent 178. FIG. 19 also shows the vestibule 16 having at least one light fixture 180 attached to the ceiling, and air flow ports or vents 56. Of course these features are exemplary and other embodiments may include other features.

An exemplary prefabricated armory enclosure is prewired. As previously discussed, a vault ceiling and side walls can have one or more insulation panels with the Kemlite™ film or other suitable material facing the vault interior. To this Kemlite™ film material (or insulation panels), light fixtures can be attached along with wiring for electric outlets, phone jacks, and computers. The wiring can be inside of a protective metal conduit.

Outlets (electrical, phone, data, etc.) can also be located on the exterior of the enclosure, including the front wall. For example, at least one exterior electrical outlet with GFI protection can be located at the front wall. These outside outlets can be positioned so that their outermost part is substantially flush with its surrounding outer wall surface. A prewired vault, including lighting fixtures, data lines, communication lines, outlets, and the like, facilitates its installation and use.

Figures 20, 21, 22, 23, 24, 25, 26, 27, 28:
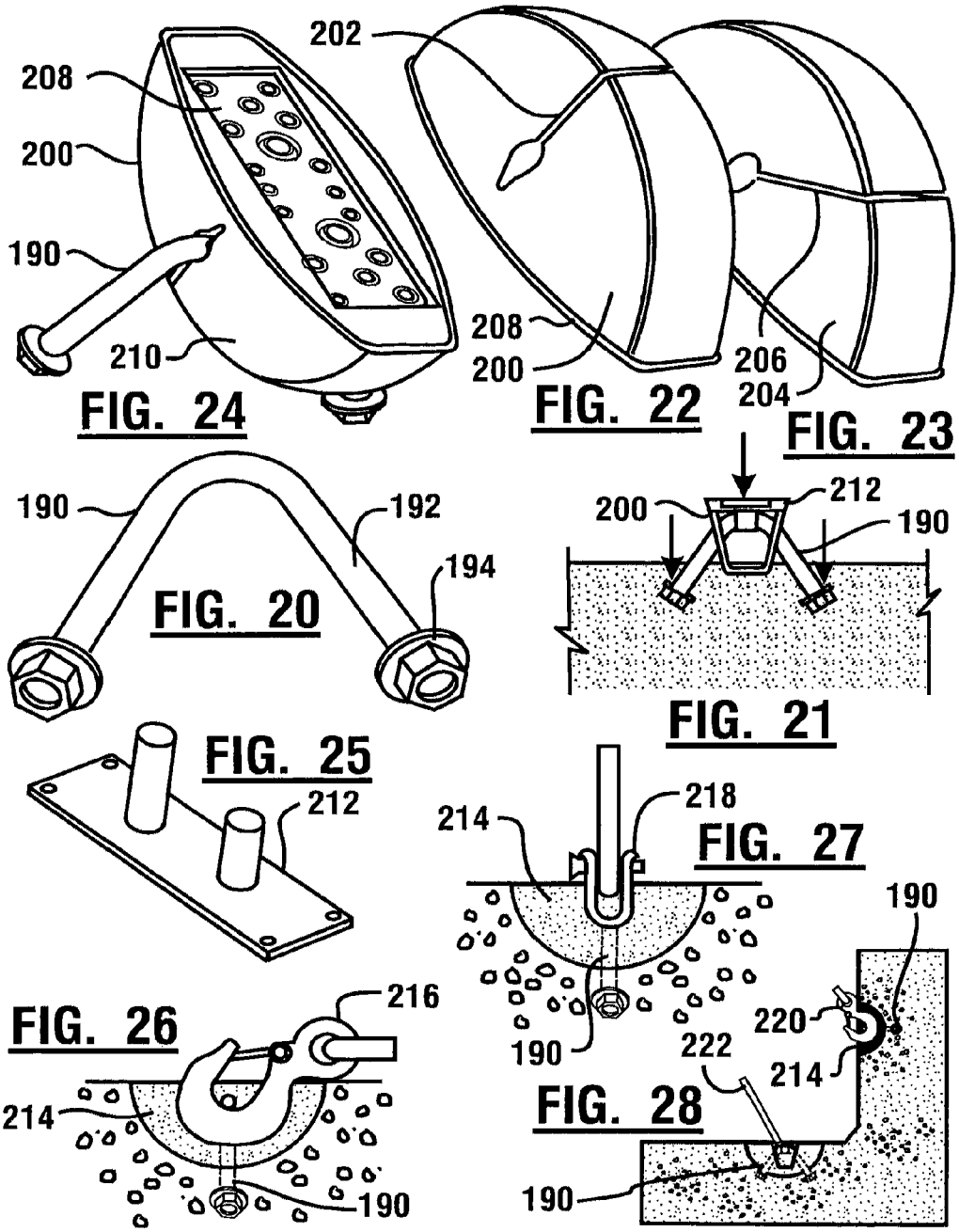
FIG. 20 shows an item securing anchor.
FIG. 21 shows setting an anchor in wet concrete.
FIG. 22 shows a setting plug.
FIG. 23 shows another setting plug.
FIG. 24 shows an anchor in a plug.
FIG. 25 shows a closure element for a plug.
FIG. 26 shows a securing component attached to an anchor extending into a recessed cavity in concrete.
FIG. 27 shows another fastening component attached to an embedded vault anchor.
FIG. 28 shows an anchor in a vault side wall and another anchor in the vault floor.

The interior of the vault 14 includes cast-in metal anchors 190 (FIG. 20). The anchors are attached to the vault's interior floor and/or interior walls. In an exemplary embodiment, an anchor 190 comprises a metal bar portion 192 having a generally V-shape or U-shape, as shown in FIG. 20. The metal bar has a flange portion 194 at each end of the V. The radially extending flanges 194 help to fix the anchor 190 to concrete. Vault anchors 190 can be attached by having an end of each anchor embedded in the concrete of a floor panel 24 or a wall panel 20, 26, 28, 30. Anchors of many different sizes and shapes can be used. The anchors 190 are adapted to receive chains, wire ropes, rods, or other securing items or structure therethrough to secure items such as rifles, weapons, or other armaments in locked position in the vault.

The flange end of an anchor 190 can be inserted into the concrete during the casting of a floor panel or wall panel (e.g., in unset concrete; FIG. 21). After the concrete hardens, the end of the anchor opposite the flanges extends from its panel surface. That is, the center point of the V extends outward from the concrete. The V creates a passage between the bar and an interior concrete (floor or wall) surface of the vault. Securing structure can be passed through the passage created by the V-shaped anchor. A single securing member (e.g., chain or bar) may pass through several anchors situated in a predetermined arrangement of vault anchors, including parallel aligned anchors.

In another exemplary embodiment an insert or plug can be used to enable an anchor to be positioned in a recess below a concrete surface. FIGS. 22 and 23 respectively show different plugs 200, 204 having differently positioned slots 202 and 206. A plug can be comprised of a removable material such as rubber, plastic, wood, paper, etc. A setting plug 200 (FIG. 24) has a top portion 208 and a bottom portion 210. The top portion 208 may be substantially flat and/or have openings/slots for receiving corresponding projections of a closure member 212 (FIG. 25). The plug cover 212 can be used to keep concrete out of the plug interior. Likewise, the slots 202, 206 can have a tight fitting clearance to prevent concrete therethrough.

A V-shaped bar 192 of an anchor 190 is extended into a plug 200 via the plug slot 202 (FIG. 24). The top of the anchor 190 is level with or below the top of the plug 200. When the anchor 190 is inserted in the plug 200 then the anchor flanges 194 extend outward from the plug. The plug 200 along with the attached anchor 190 can then be placed into unset concrete of a floor panel or wall panel (FIG. 21). The arrows in FIG. 21 represent the direction of insertion. The top of the inserted plug 200 can be situated so that it is level with the concrete surface. After the concrete hardens, portions of the plug 200 and anchor 190 are embedded in the concrete. The ends of the metal bar 192 (which include the flanges 194) are securely fixed in the hardened concrete.

The plug 200 can then be removed from the concrete to produce a recess 214 in the concrete panel (FIGS. 26-28). The recessed area or cavity is devoid of concrete. Removal of a plug 200 can comprise a process involving cutting, burning, heating, dissolving, and/or chemical reaction, etc. The created recess 214 includes the end of the anchor opposite the flanges. The anchoring flanges 194 are embedded in the concrete beyond (e.g., below) the recess 214. This approach produces a metal bar 192 in a recess 214 of a vault floor or interior vault wall that can be engaged with a securing device to secure items such as racks, rifles, or other armaments in position in the vault. FIGS. 26-28 show recessed anchors 190 respectively attached to various securing devices 216, 218, 220, 222. In FIGS. 26-28 the recessed cavities 214 are shown darkened to distinguish them from surrounding concrete. FIG. 28 shows a vault interior having both a recessed floor anchor and a recessed wall anchor.

Using a cavity-creating plug 200 enables the visible section (upper portion) of an anchor 190 to be positioned level with or below the concrete surface of an enclosure floor panel or a wall panel. Because the floor anchors can be positioned at or below the level of the vault floor surface instead of protruding therefrom, the tripping of a person in the vault on an anchor can be eliminated. Lowered floor anchors and wall anchors also enhance storage layout options in the vault. It should be understood that an enclosure can include anchors in any of its concrete panels, including the front wall 18, rear wall 20, roof wall 22, floor wall 24, side walls 26, 28, and dividing wall 30. In an exemplary anchor arrangement, five recessed anchors are located in a rectangular vault floor in an X-shaped pattern, with one anchor adjacent each vault corner and another anchor located adjacent the center of the floor.

It should be understood that the anchor examples shown and discussed are exemplary and that other anchor shapes, configurations, and arrangements can be used. For example, another arrangement can comprise an anchor having one flange portion embedded in a floor and the other flange portion embedded in a wall.

Figure 29:
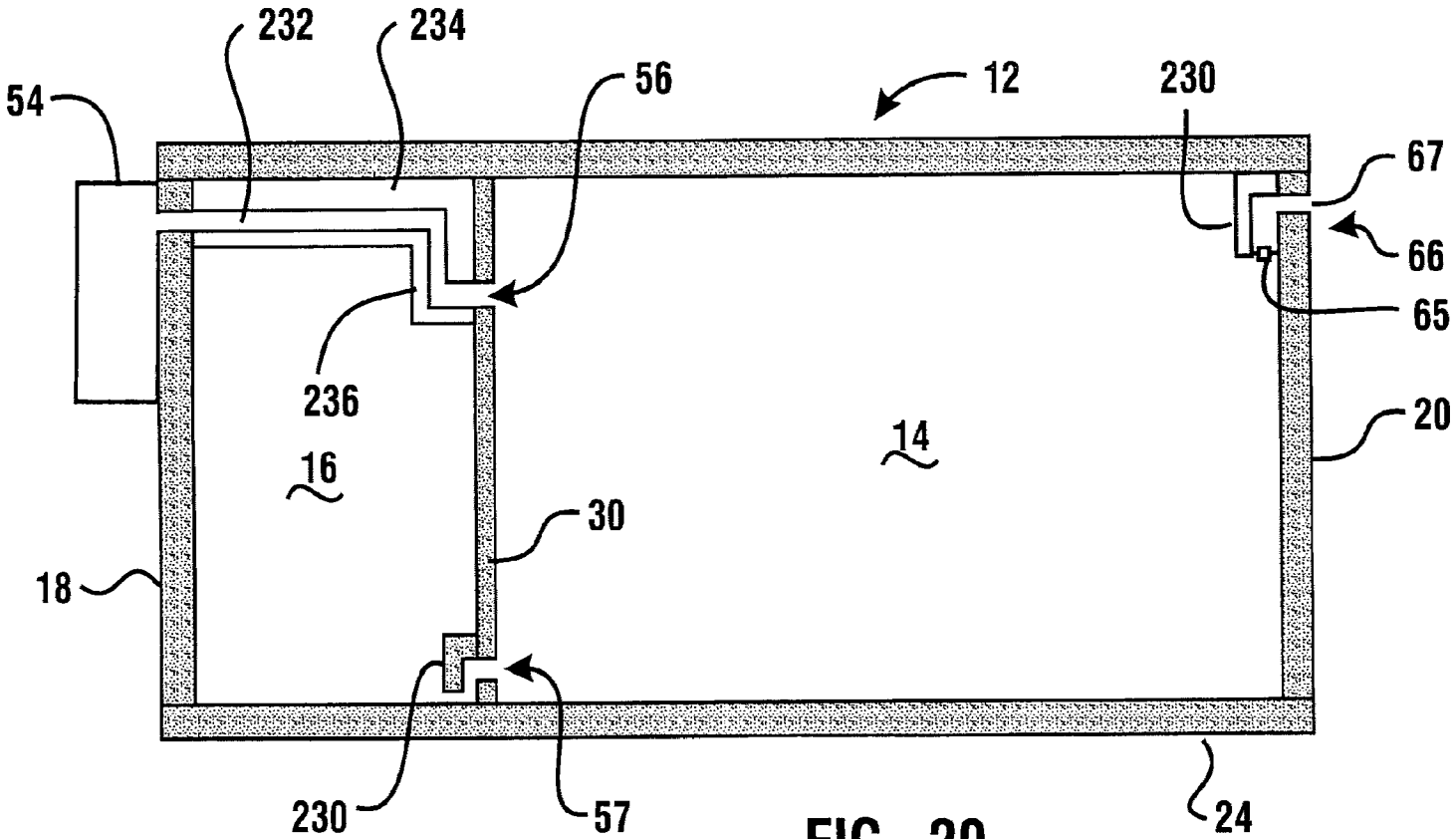
FIG. 29 shows concrete air flow ducts in an enclosure.

An air flow duct work arrangement for an armory enclosure 12 will now be discussed. FIG. 29 shows a HVAC unit 54, a vault inlet port 56, a dividing wall outlet port 57, and a vault air exhaust unit 66 including an exhaust fan 65 and an exhaust vent 67. The ports 57 and vents 67 of the exemplary enclosure 12 are protected by adjacently mounted concrete security covers 230. The L-shaped covers 230 which in the exemplary embodiment are in cross section are another security feature for protection of the vault interior 14. The security covers 230 prevent straight through access to a port/vent. That is, with a cover 230 mounted at a port/vent passage there is no direct line of access through the passage. A concrete duct cover 230 requires that an object be turned 90 degrees before being allowed to enter/exit a passage. Each duct adjacent a port/vent acts as an angled elbow. A cover 230 hinders the transit of an object through a port/vent passage yet readily permits the flow of air therethrough.

FIG. 29 also shows a hollow concrete duct 232 extending from the front wall 18 to the port 56 in the interior dividing wall 30. The air flow duct 232 is located in the vestibule area. The duct 232 connects the HVAC unit 54 to the vault 14. The duct 232 includes an elongated horizontal portion 234 and a concrete cover portion 236. Air flows through a passageway created by the concrete duct 232. The interior of the duct 232 can be lined with metal sheeting.

Figure 30:
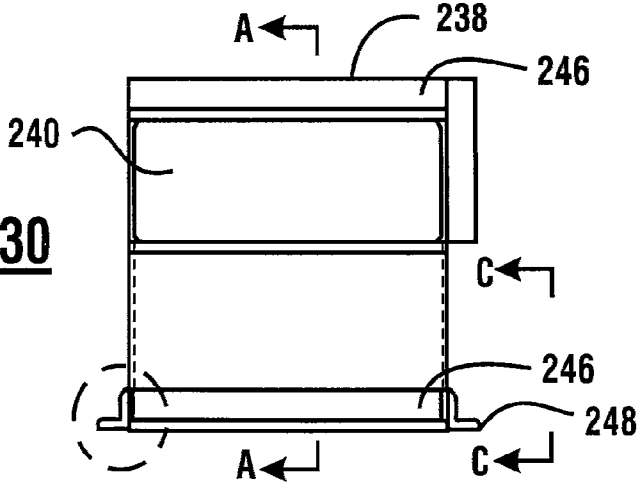
FIG. 30 shows a concrete duct.
Figure 32:
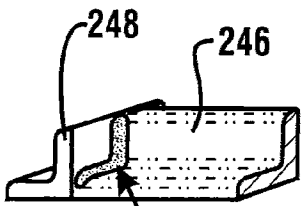
FIG. 32 shows an enlarged view of the circled portion of FIG. 30.
Figure 33:
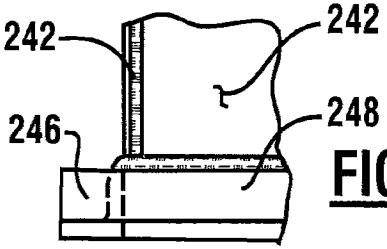
FIG. 33 shows a view taken along C-C of FIG. 30.
Figure 31:
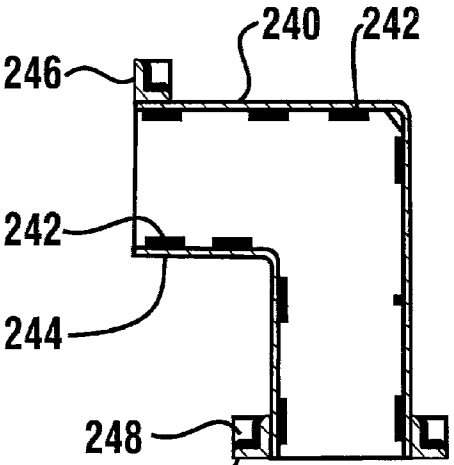
FIG. 31 is a side view of the duct of FIG. 30.

FIG. 30 shows an exemplary example of a concrete duct 238. Different views of FIG. 30 are represented in FIGS. 31-33. FIG. 31 is a view taken along section A-A; FIG. 32 is an angled view of encircled area B; and FIG. 33 is a view taken along section C-C of FIG. 30.

The exemplary duct 238 includes a concrete cover 240 (FIG. 31). The cover 240 can be separately (independently) cast and then attached to a wall surface of the armory enclosure 12. The cover 240 (and duct 238) includes metal plates 242 embedded therein at outer surfaces. The metal plates 242 enable a passageway-bounding metal sheeting 244 to be fastened (e.g., welding, hot isosatic pressing, etc.) thereto. The metal plates 242 also enable the cover 240 to be fastened to an adjacent enclosure wall (e.g., front wall 18, rear wall 20, roof wall 22, side walls 26, 28, and interior wall 30). The enclosure wall likewise has metal plates embedded therein at an outer surface. Concrete duct structure 238 can be positioned relative to a supporting wall so that metal plates 242 in the concrete cover 240 are corresponding aligned with metal plates in the supporting wall. The adjacent/contacting metal plates can then be fastened (e.g., welded) to each other. Similarly, all of the concrete duct work in FIG. 29, including the elongated horizontal portion 234, can be wall supported by using correspondingly fastened metal plates 242.

The exemplary duct 238 (and cover 240) also includes metal flanges 246, 248. The metal flanges 246, 248 can also be used to attach the duct structure 238 to a support wall. Metal flanges 246, 248 can be fastened 247 (e.g., welded) to each other (FIG. 32), to metal plates 242 (FIG. 33), or embedded in the concrete.

A concrete enclosure duct 232, 238 can be mountedly supported either interior or exterior of an armory enclosure 12. A duct 232, 238 can be supported by a single wall (e.g., top wall 22 or a side wall 26, 28). Alternatively, a duct 232, 238 can be supported by plural walls (e.g., front wall 18, top wall 22, side wall 26, 28, and interior wall 30). Likewise, a concrete cover 230, 236, 240 can be supported by one or more enclosure walls, including interior or exterior of the enclosure.

In another duct support arrangement, a concrete duct may be integrally formed with a concrete wall as a single unitary structure. That is, the concrete duct can be formed when its supporting concrete wall is formed. The duct and wall can be simultaneously cast together. In still another duct support arrangement, a first duct portion of a concrete duct may be cast with a supporting wall while a second duct portion is separately cast. The second duct portion can then be fastened to metal plates embedded in the first duct portion and/or supporting wall.

Figure 34:
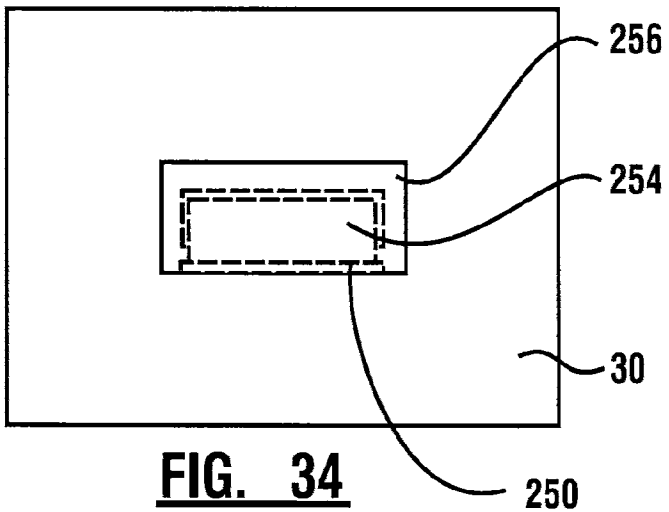
FIG. 34 shows a concrete cover for a wall vent.
Figure 37:
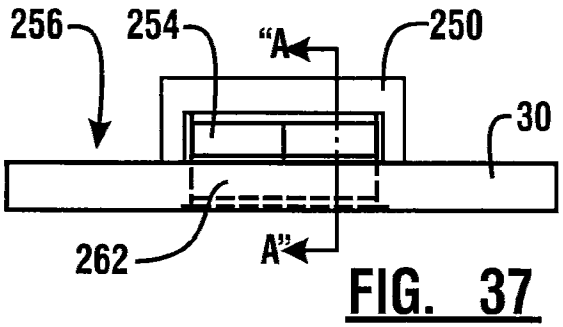
FIG. 37 shows a concrete cover positioned adjacent a wall vent port.
Figure 35:
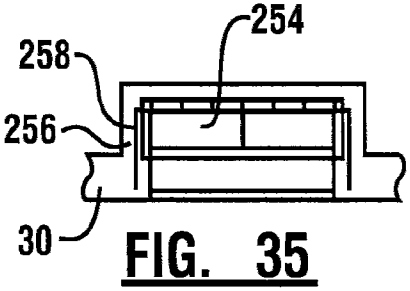
FIG. 35 shows reinforcing of the concrete cover.
Figure 36:
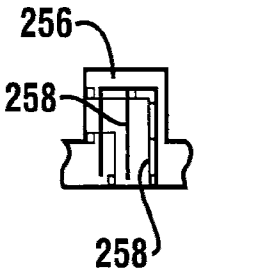
FIG. 36 shows another view of the reinforced concrete.
Figure 38:
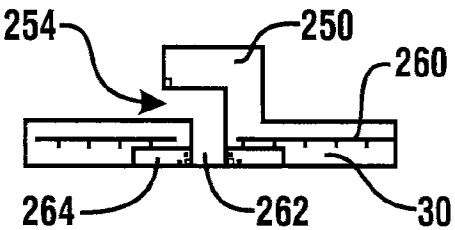
FIG. 38 shows a view taken along A-A of FIG. 37.

FIG. 34 shows another example of HVAC concrete duct structure 250 which is similar to L-shaped concrete cover 230. An air flow path 254 is created in the hollow portion of the concrete 256 (which can be attached to the interior wall 30 or rear wall 20). FIGS. 35-36 show different angled views of the concrete 256 adjacent the air flow path 254 being reinforced with rebar 258. FIG. 37 shows the duct structure 250 positioned adjacent a passage 262 through the interior wall 30. The duct structure 250 can be integrally formed with the interior wall 30. FIG. 38 is taken along section A-A of FIG. 37. FIG. 38 shows steel reinforcing rods 260 in the support wall 260. Because of the protection provided by the concrete duct structure/cover 250, the area of the interior wall 30 that is opposite the duct structure 250 can be of a smaller thickness. FIG. 38 shows vault side of the interior wall 30 having an area 264 devoid of concrete.

As previously discussed, a vestibule 16 can provide shelter for persons and equipment. Additional shelter can be provided by connecting a canopy or awning structure to the front wall of the vestibule. The awning can extend outward from the exterior vestibule door. This awning structure will enable soldiers that are standing in line outside the vestibule to also be out of the elements. Hooks, recessed anchors, or other fastener components may be embedded in the front or top exterior wall of the enclosure to assist connection of the awning to the enclosure. In an exemplary arrangement, an awning is temporarily connected to the enclosure to cover a path extending outward from the vestibule door. Of course, other structures and approaches may be used.

In another exemplary armory enclosure, the lower concrete floor 24 of the vestibule 16 extends forward (i.e., outward from the vestibule). This creates a concrete pad in front of the vestibule entry door 32. The pad can be poured separately or may be made integral with the casting of the enclosure floor panel. That is, the pad and floor can be a one piece structure. A sheltering structure can then be installed or constructed on the extending pad. The installed external structure can comprise a low cost collapsible light fabric, metal, wood, or plastic panel structure. The sheltering structure can also be of a size similar to that of the vault.

An additional protective area (whether provided by an awning structure or a sheltering structure with or without a concrete pad) outside of the vestibule entrance can serve many purposes. For example, the area can be use to clean rifles and other weapons prior to their return to storage in the vault. A degreaser unit can be positioned in the external area. Typically, degreasers use a solvent-based material for removing dirt and grease from the weapons. It may be desirable to keep the degreaser unit (with its solvent-based material) outside of the vault interior to avoid any buildup of fumes. The additional external area can have ample ventilation. The additional working area can be temporarily setup to provide environmental protection to a soldier cleaning his weapon, the degreaser unit, and other associated hardware.

Figure 39:
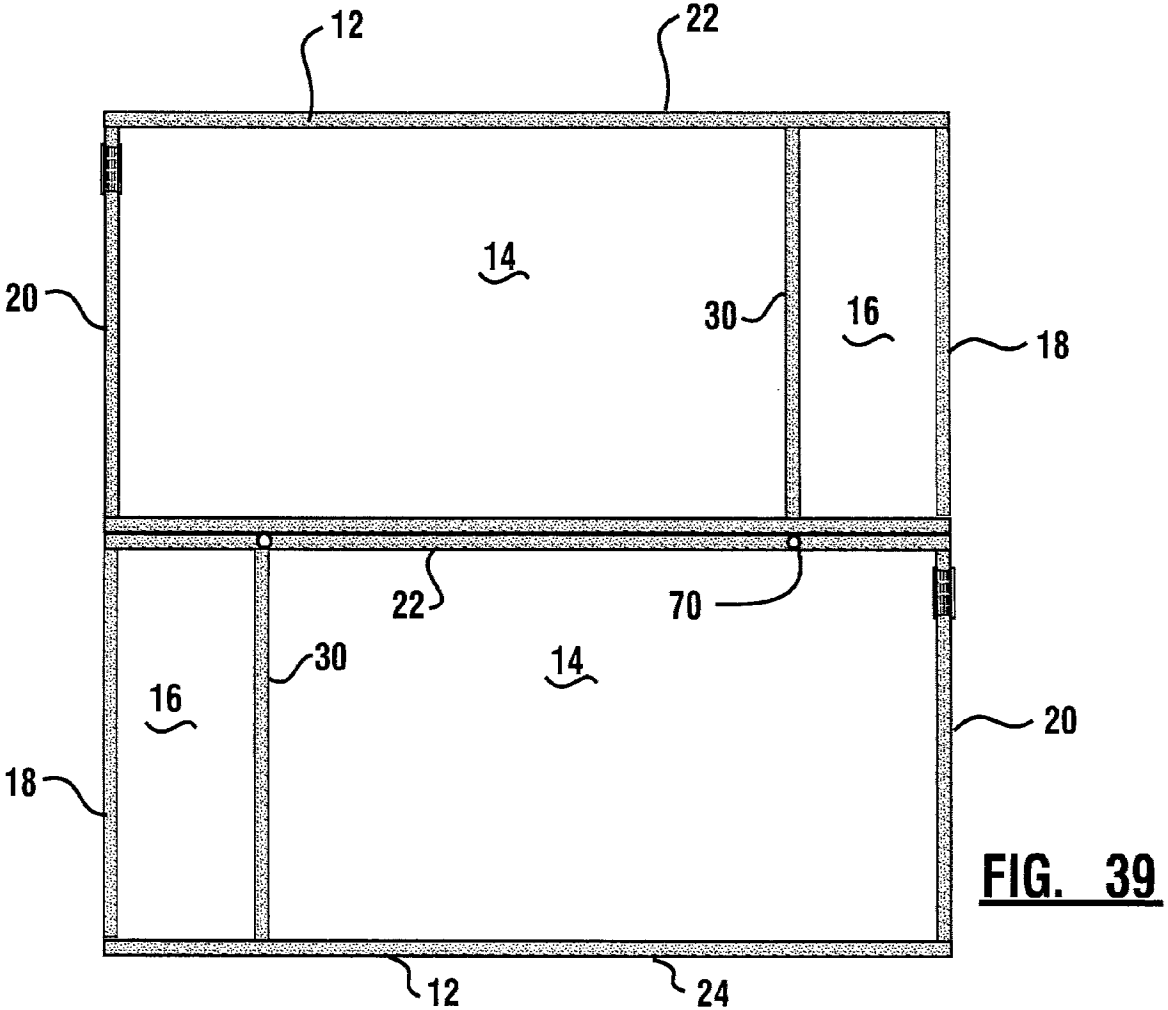
FIG. 39 shows stacked armory enclosures.

The exemplary armory enclosure 12 may also be used as part of a modular structure. For example, an armory enclosure can be stacked on top of another armory enclosure, as shown in FIG. 39. A stairway, ramp, ladder, or lift device can be used to reach the higher vestibule. Modular enclosures can be stacked whether they have a flat roof, a slanted roof, or a combination thereof. For example, an enclosure having a sloped roof can be stacked upon an enclosure having a flat roof. Enclosures can also be stacked so that the exterior vestibule doors are at opposite ends in order to keep operations separated and prevent interference when the enclosures are simultaneously being used. FIG. 39 also shows lifting cams 70 attached to an enclosure roof slab 22.

Figure 40:
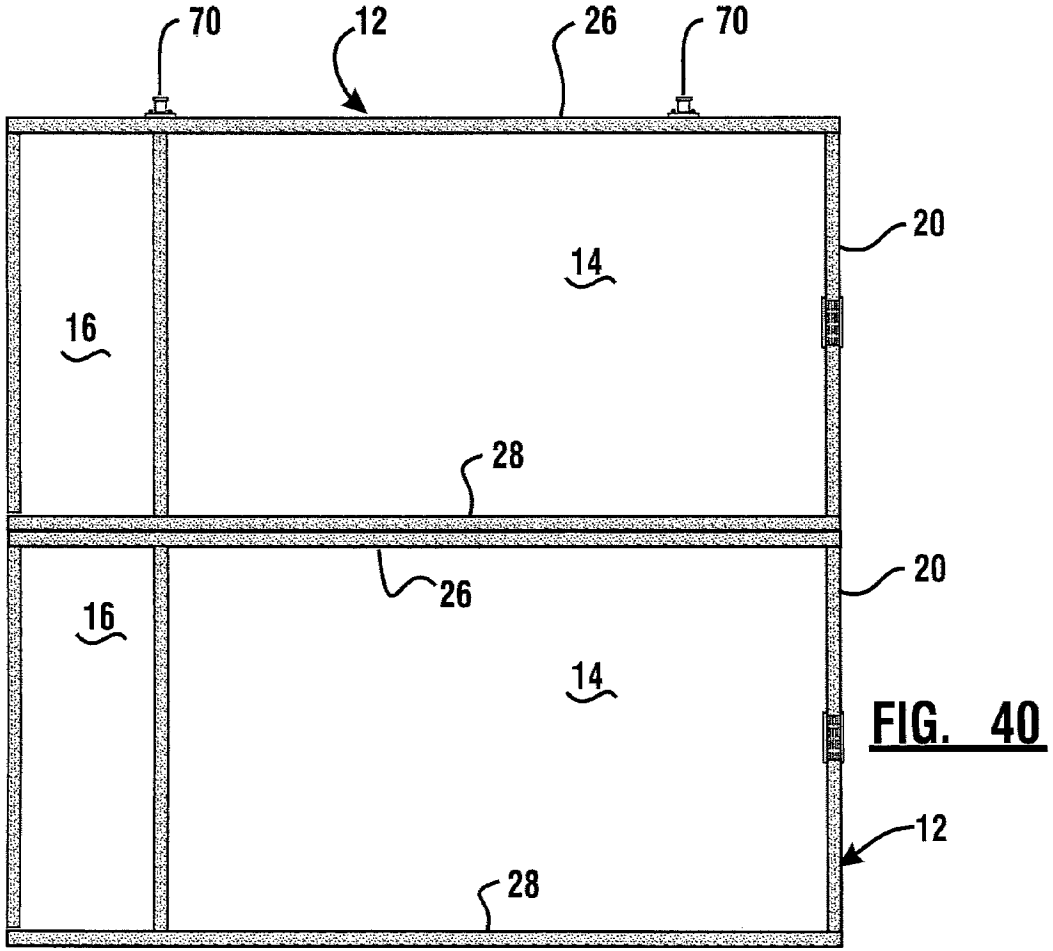
FIG. 40 shows aligned armory enclosures contacting each other along a common side.

As previously discussed, exemplary armory enclosures 12 can also be abutting each other side by side, as shown in FIG. 40. FIG. 40 shows one enclosure having all of its lifting cams removed, whereas the other enclosure has lifting removed from only one side. Removal of lifting cams 70 enables adjacent enclosure side walls to directly abut each other along their entire length when placed in a side by side arrangement. With some lifting cams removed, other positioning techniques can be used in order to locate one enclosure into side by side abutting contact with another enclosure. For example, the pushing or pulling of an enclosure may be executed by machinery (e.g., a bulldozer).

It follows that a stack of armory enclosures can also abut or touch another stack of armory enclosures at their common side. That is, one lower and upper side portion of two stacked armory enclosures can be aligned with and engage a respective lower and upper side portion of two other stacked armory enclosures.

Figure 41:
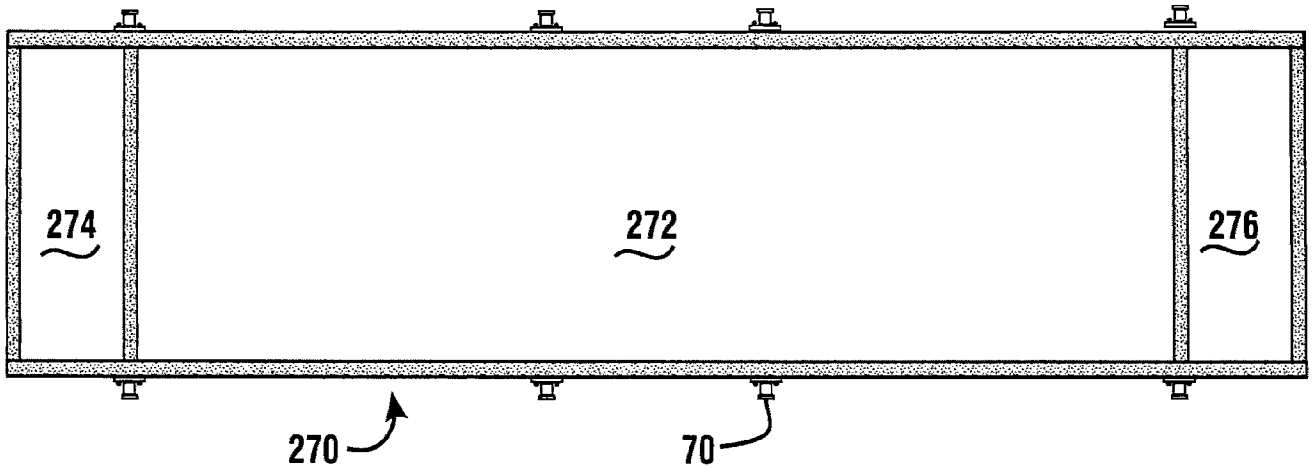
FIG. 41 shows an extended armory vault apparatus.

As previously discussed, exemplary armory enclosures 12 can be modularly extended vertically (stacked) and laterally (side-to-side). However, armory enclosures 12 can also be modularly extended horizontally (end-to-end). An armory enclosure unit 12 can be fabricated without a rear wall installed or with end walls having mating passages. This construction enables two identical modular armory enclosures to be placed in substantial alignment so that they abut or touch (be stacked) end to end. That is, the open end of one unit is placed next to the open end of the other unit, as shown in FIG. 41. As a result, an extended armory enclosure 270 (e.g., twice the standard length) can be provided. The elongated vault 272 would have two entrances via two vestibules 274, 276. The extended armory enclosure 270 may comprise a vestibule at each outer end, two vault doors, and a lengthened vault. When one vestibule is not in use, the vault door in that end portion of the extended armory enclosure could remain closed. If necessary, the engaged ends can be further connected and/or sealed to prevent infiltration of liquid (water) therebetween. Without a rear wall, one or more air exhaust units can be included in one or more of the other walls.

Figure 42:
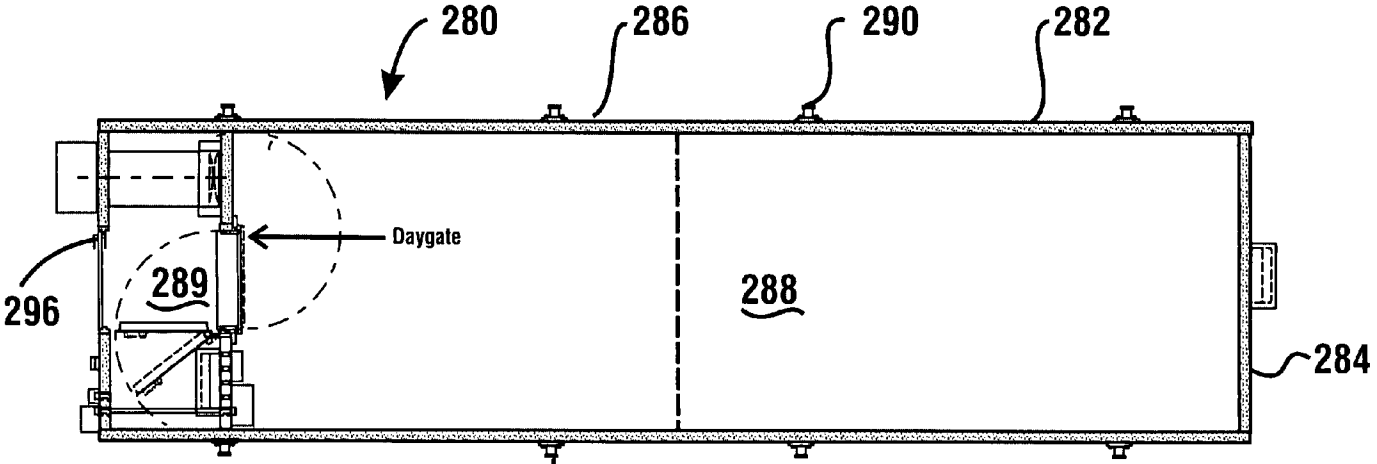
FIG. 42 shows another extended armory vault apparatus.

Additionally, an exemplary armory enclosure without a rear wall or with a suitable passage can be combined with a separate concrete vault structure. The combination produces another extended armory enclosure 280, as shown in FIG. 42. The separate vault structure 282 has a rear wall 284 but no front wall or vestibule. The open end of the vault structure 282 is placed in abutting engagement with the open end of the rear wall-less armory enclosure 286. The abutting engagement is represented by the broken lines. The separate vault structure 282 can be of various lengths, including substantially the same length as the rear wall-less armory enclosure. This exemplary modular construction enables the armory vault 288 to be longer without requiring more than one vault entrance.

Figure 43:
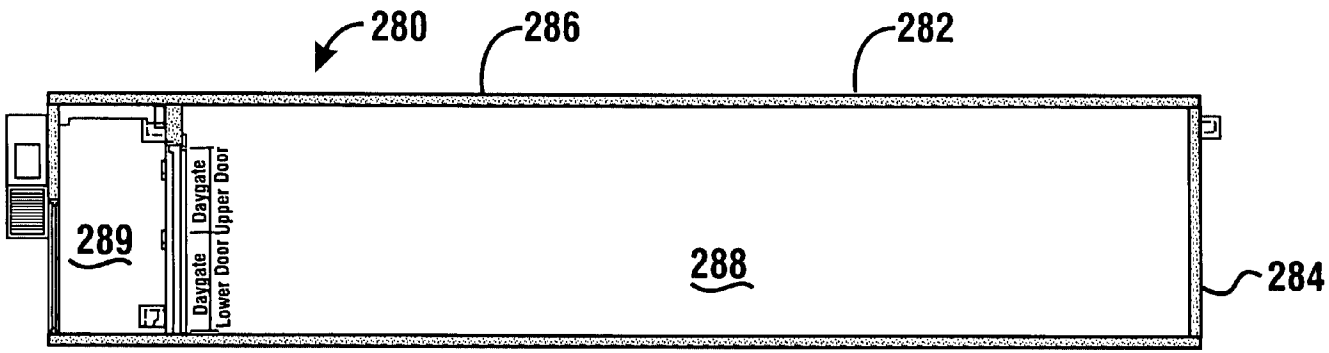
FIG. 43 shows a side view of the apparatus of FIG. 42.
Figure 44:
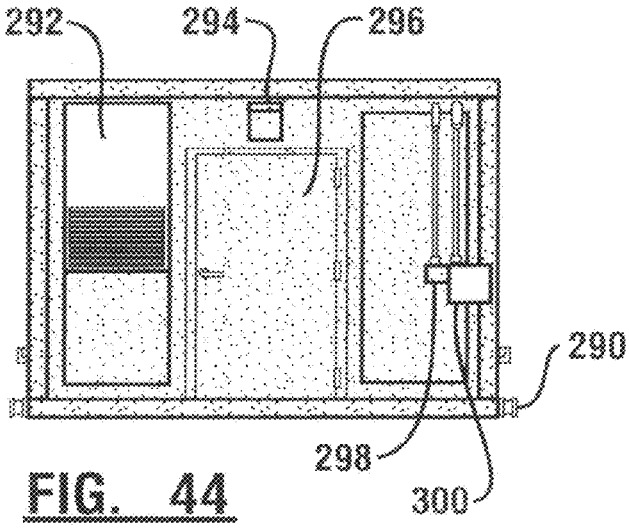
FIG. 44 shows a front view of the apparatus of FIG. 42.
Figure 45:
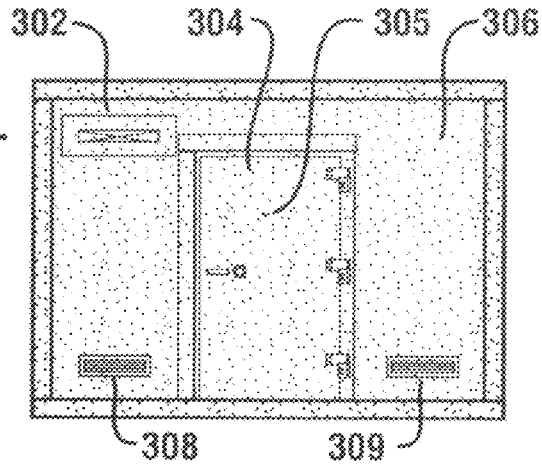
FIG. 45 shows an inside view of the apparatus of FIG. 42.
Figure 46:
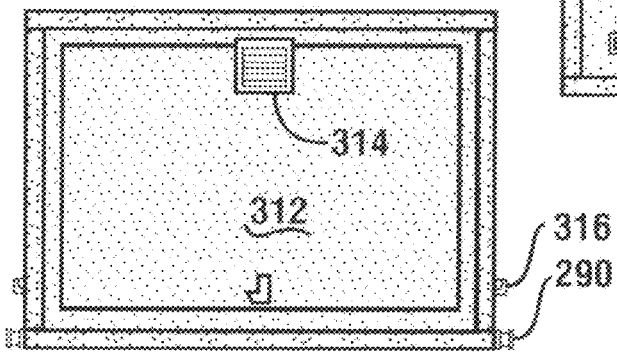
FIG. 46 shows a rear view of the apparatus of FIG. 42.

FIG. 42 is a top view of the resulting armory enclosure 280 having an extended vault 288 and a vestibule 289. Lifting cams 290 and a daygate are also shown. Different views of the extended armory enclosure 280 of FIG. 42 are shown in FIGS. 43-46. FIG. 43 is cut away a side view. FIG. 44 is an exterior front view. FIG. 44 further shows engagement cams 290, a front wall mounted HVAC unit 292, exterior light 294, vestibule entrance door 296, communications box 298, and a central power supply 300. FIG. 45 is an inside vestibule view. FIG. 45 further shows an HVAC port 302, a vault door 304 having a peep hole 305, conduit penetrations 306, and air returns 308, 309 through the interior wall 310. The peep hole 305 enables the interior area 288 of the vault to be checked while the vault door 304 is closed. A light switch in the vestibule 289 can be used to turn on lights in the vault area 288. FIG. 46 is an exterior rear view. FIG. 46 further shows a rear wall 312, an exhaust unit 314, and electric outlets 316.

One or more vehicles (e.g., truck, train, etc.) can be used to transport an exemplary enclosure. The vehicles may include a flat bed truck trailer or a flat bed rail car. In an exemplary installation arrangement, an enclosure that requires two or more trucks for transport only needs to have its adjoining seam(s) rejoined and sealed.

In an exemplary transport arrangement, a mobile armory enclosure is transported empty. However, it should be understood that an exemplary armory enclosure has the ability to be lifted and moved while in a loaded condition, including weapons anchored in place in the interior thereof. As previously discussed, the structure and shape of the concrete walls enables them to be strong enough to withstand the armory enclosure weight and the vibration associated with transport. The poured concrete creates beams or ribs which are the thickened areas in the various enclosure wall panels, as previously discussed. These concrete beams enable the concrete to support the weight of the relocatable armory enclosure.

Installed armory enclosures can be of various sizes, including custom sizing and special sizes. For example one enclosure may have 208 sq. ft. (square feet), whereas another enclosure has 360 sq. ft.

An exemplary example of a relocatable and reusable armory enclosure will now be further described. It should be understood this enclosure description is an example and that other enclosure configurations and components can be used. The enclosure of the exemplary example is factory assembled and then transported to the work site. It has an UL Class M construction and meets standard #608 attack resistance. The enclosure satisfies AR 190-11 for storage of Category II arms. The enclosure is insulated to provide the walls and ceiling structure with at least an overall R-8 insulation rating. The HVAC and humidity control may have a heating and/or cooling capacity specified to reflect the climate conditions of the installation area. The exemplary roof exterior is pitched 1 inch side to side to assist precipitation runoff and minimize roof load stress.

The all weather vestibule of the exemplary embodiment protects visiting personnel and the vault door from adverse weather. The vestibule is an integral part of the vault itself. An exterior overhead safety light is mounted above the front door of the exemplary enclosure. The light can improve the safety and security of personnel entering and exiting the vestibule.

The enclosure exterior has at least one GFI-protected electrical outlet receptacle, with at least one receptacle located on the front wall. Electrical outlets are mounted flush with their wall. The outlets have removable polycarbonate weather shields. The outlets provide the ability to tap into the electricity grid when working in the exterior vicinity of the enclosure.

The enclosure interior has approximately two electrical outlet receptacles and phone jacks for every ten feet of linear wall space. An interior wire-mold conduit allows for the flexibility of outlets to be easily relocated and added for future applications. The enclosure is pre-wired for communication in a suitable intrusion detection system and for connection in a computer network. Conduit penetrations and a panel mounting area assist wiring installation. The exemplary interior walls are painted reflective white to enhance lighting and provide a bright clean working environment. The insulation panels in the ceiling are also reflective white. The interior side walls and floor of the vault include securement anchors (or moors) for use in securing gun racks and other stored components.

The vault door includes an X-09 type lock. The vault door is rated Class 5A for GSA Armory Classification AA-D-600D. The vault door construction meets or exceeds GSA security standards for attack resistance and combination manipulation. The vault door also has ballistic protection which qualifies it for State Department vault certification. The Dutch daygate enables maximum workflow while still maintaining extensive security for the vault.

It should be understood that the concrete enclosures described herein can be used for other purposes and are not limited to the storage of weaponry. Additional applications can include use as a military brig, an (in ground) storm shelter, a nuclear fallout shelter, a bomb diffusing lab, or as part of a radioactive material storage facility, for example.

Thus, the features and characteristics of the embodiments previously described achieve desirable results, eliminate difficulties encountered in the use of prior devices and systems, solve problems and attain one or more of the objectives stated above.

In the foregoing description certain terms have been used for brevity, clarity and understanding, however no unnecessary limitations are to be implied therefrom because such terms are for descriptive purposes and are intended to be broadly construed. Moreover, the descriptions and illustrations given herein are by way of examples and the invention is not limited to the exact details shown and described.

In the following claims any feature described as a means for performing a function shall be construed as encompassing any means capable of performing the recited function, and shall not be deemed limited to the particular means shown in the foregoing description or mere equivalents thereof.

Having described the features, discoveries and principals of the invention, the manner in which it is constructed, operated, and utilized, and the advantages and useful results attained; the new and useful structures, devices, elements, arrangements, parts, combinations, systems, equipment, operations, methods, processes, and relationships are set forth in the appended claims.

We claim:

1. Apparatus comprising:

a relocatable armory enclosure, wherein the armory enclosure includes a plurality of walls including at least a front wall, a rear wall, side walls, and a roof slab wall, wherein the walls are operatively connected to each other forming an integral unit, wherein each side wall comprises metal fiber reinforced concrete, wherein the concrete enables the armory enclosure to be lifted as a single unit via a lifting force that is transferred through the concrete during lifting of the armory enclosure, wherein the armory enclosure includes a security door, a vestibule area, a dividing wall, a split door, and a vault area configured for weapons storage, wherein the security door is movable to permit passage of a person between an area outside the armory enclosure and the vestibule area, wherein the dividing wall separates the vestibule area from the vault area, wherein the dividing wall includes a wall opening, wherein the split door is mounted to the dividing wall, wherein the split door is movable to permit passage of a person between the vestibule area and the vault area through the wall opening, wherein the split door includes a hinged upper gate and a hinged lower gate, wherein at least one of the gates is independently movable relative to the other gate.

2. The apparatus according to claim 1 wherein the split door comprises a daygate, wherein the daygate includes openings allowing viewing therethrough, wherein each gate is independently movable relative to the other gate, wherein the daygate in a fully closed position prevents passage of a person through the wall opening.

3. The apparatus according to claim 2 wherein the daygate includes a weapons slot, wherein the weapons slot is sized to allow a weapon to be passed therethrough while the daygate is in the fully closed position.

4. The apparatus according to claim 1 wherein each side wall comprises metal fiber reinforced concrete having a compressive strength of at least 15,000 psi.

5. The apparatus according to claim 1 wherein the vault area includes a concrete floor, wherein the vault area includes at least one metal securing anchor, wherein each anchor comprises an first portion and a second portion, wherein each first portion is cast in the concrete floor, wherein each second portion extends outward from the concrete floor.

6. The apparatus according to claim 5 wherein each second portion forms a closed inverted V-shape or a U-shape extending outward from the concrete floor, wherein the shape is sized to allow a weapons-securing chain to be passed therethrough.

7. The apparatus according to claim 1 wherein each wall of the front wall, rear wall, and roof slab wall comprise a concrete wall, wherein the roof slab wall includes a roof exterior surface exposed to ambient, wherein at least a portion of the roof exterior surface has a predetermined slope.

8. The apparatus according to claim 1 wherein each respective side wall includes a plurality of mounting plates embedded in concrete of the respective side wall, wherein each respective embedded mounting plate includes a plurality of spaced fastener mating portions, wherein the fastener mating portions of a respective embedded mounting plate are configured to respectively mate with fasteners in removably mechanically mounting a lifting cam to the respective embedded mounting plate, wherein during lifting of the armory enclosure, the lifting force is transferred through the embedded mounting plates.

9. The apparatus according to claim 8 wherein each respective side wall includes a concrete exterior surface, wherein each respective concrete exterior surface is exposed to the ambient, wherein each mounting plate includes a plate exterior surface, wherein each respective plate exterior surface is exposed to ambient, wherein each respective plate exterior surface is substantially flush with a respective concrete exterior surface.

10. The apparatus according to claim 8 wherein each respective fastener mating portion comprises a threaded portion, wherein the threaded portions of a respective embedded mounting plate are configured to respectively matingly engage threaded portions of fasteners in removably mechanically mounting the lifting cam to the respective embedded mounting plate.

11. The apparatus according to claim 8 wherein each side wall comprises metal fiber reinforced concrete having a compressive strength of at least 15,000 psi.

12. Apparatus comprising:

a relocatable enclosure, wherein the enclosure includes a plurality of walls including at least a front wall, a rear wall, side walls, and a roof slab wall, wherein each wall of the front wall, the rear wall, the side walls, and the roof slab wall comprise concrete, wherein each respective side wall includes metal fiber reinforced concrete, wherein each respective side wall includes a plurality of metal mounting plates embedded in the metal fiber reinforced concrete of the respective side wall, wherein each respective embedded mounting plate includes a plurality of spaced mating portions, wherein the spaced mating portions of a respective embedded mounting plate are configured to respectively correspondingly mate with portions of fasteners operative to removably mechanically mount a lifting cam to the respective embedded mounting plate, wherein the enclosure includes a door and an interior area, wherein the door is movable to permit passage of a person between an area outside the enclosure and the interior area, wherein the enclosure is able to be lifted as a single unit by a lifting force, wherein during lifting of the enclosure, the lifting force is transferred through the embedded mounting plates and through the metal fiber reinforced concrete of the side walls.

13. The apparatus according to claim 12 wherein the enclosure comprises an armory enclosure, wherein the interior area includes a vault area configured for weapons storage.

14. The apparatus according to claim 13 wherein the enclosure includes a security door, a vestibule area, a dividing wall, and a split door, wherein the security door is movable to permit passage of a person between an area outside the armory enclosure and the vestibule area, wherein the dividing wall separates the vestibule area from the vault area, wherein the dividing wall includes a wall opening, wherein the split door is mounted to the dividing wall, wherein the split door is movable to permit passage of a person between the vestibule area and the vault area through the wall opening, wherein the split door includes a hinged upper gate and a hinged lower gate, wherein at least one of the gates is independently movable relative to the other gate.

15. The apparatus according to claim 14 wherein the split door comprises a daygate, wherein the daygate includes openings allowing viewing therethrough, wherein each gate is independently movable relative to the other gate, wherein the daygate in a fully closed position prevents passage of a person through the wall opening.

16. Apparatus comprising:

a relocatable enclosure, wherein the enclosure comprises an armory enclosure, wherein the enclosure comprises a concrete floor, wherein the enclosure includes a plurality of walls including at least a front wall, a rear wall, side walls, and a roof slab wall, wherein each wall of the front wall, the rear wall, the side walls, and the roof slab wall comprise concrete, wherein each respective side wall includes metal fiber reinforced concrete wherein each respective side wall includes a plurality of metal mounting plates embedded in the metal fiber reinforced concrete of the respective side wall, wherein each respective embedded mounting plate includes a plurality of spaced mating portions, wherein the spaced mating portions of a respective embedded mounting plate are configured to respectively correspondingly mate with portions of fasteners operative to removably mechanically mount a lifting cam to the respective embedded mounting plate, wherein the enclosure includes a door and an interior area, wherein the door is movable to permit passage of a person between an area outside the enclosure and the interior area, wherein the interior area includes a vault area configured for weapons storage, wherein the vault area includes at least one metal securing anchor, wherein each anchor comprises a first portion and a second portion, wherein each first portion is cast in the concrete floor, wherein each second portion extends outward from the concrete floor, wherein each second portion forms a closed loop extending outward from the concrete floor, wherein the loop is sized to allow a weapons-securing chain to be passed therethrough, wherein the enclosure is able to be lifted as a single unit by a lifting force, wherein during lifting of the enclosure, the lifting force is transferred through the embedded mounting plates and through the metal fiber reinforced concrete of the side walls.

17. The apparatus according to claim 12 wherein the metal fiber reinforced concrete has a compressive strength of at least 15,000 psi.

18. The apparatus according to claim 12 wherein each respective side wall includes a concrete exterior surface, wherein each respective concrete exterior surface is exposed to the ambient, wherein each mounting plate includes a plate exterior surface, wherein each respective plate exterior surface is exposed to ambient, wherein each respective plate exterior surface is substantially flush with a respective concrete exterior surface.

19. The apparatus according to claim 12 wherein the spaced mating portions of a respective embedded mounting plate comprise one of outwardly extending male portions configured to respectively correspondingly be received in female portions of fasteners operative to removably mechanically mount a lifting cam to the respective embedded mounting plate, or inwardly extending female portions configured to respectively correspondingly receive therein male portions of fasteners operative to removably mechanically mount a lifting cam to the respective embedded mounting plate.

20. The apparatus according to claim 19 wherein the spaced mating portions of a respective embedded mounting plate comprise spaced threaded portions, wherein the spaced threaded portions of a respective embedded mounting plate are configured to respectively correspondingly threadingly mate with threaded portions of fasteners to removably mechanically mount a lifting cam to the respective embedded mounting plate.

* * * * *